US011584144B2

(12) United States Patent
Gohda et al.

(10) Patent No.: US 11,584,144 B2
(45) Date of Patent: Feb. 21, 2023

(54) CONVEYANCE APPARATUS AND IMAGE FORMING APPARATUS

(71) Applicants: Mitsunobu Gohda, Kanagawa (JP); Tomoaki Hayashi, Tokyo (JP); Masahiro Mizuno, Kanagawa (JP)

(72) Inventors: Mitsunobu Gohda, Kanagawa (JP); Tomoaki Hayashi, Tokyo (JP); Masahiro Mizuno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/456,424

(22) Filed: Nov. 24, 2021

(65) Prior Publication Data

US 2022/0169048 A1 Jun. 2, 2022

(30) Foreign Application Priority Data

Nov. 27, 2020 (JP) ..... JP2020-197559

(51) Int. Cl.

| | |
|---|---|
| ***B41J 29/393*** | (2006.01) |
| ***B41J 11/42*** | (2006.01) |
| ***B41J 11/00*** | (2006.01) |
| ***B41J 3/54*** | (2006.01) |

(52) U.S. Cl.

CPC ..... *B41J 11/42* (2013.01); *B41J 3/543* (2013.01); *B41J 11/0095* (2013.01)

(58) Field of Classification Search

CPC ..... B41J 11/42; B41J 29/393; B41J 11/0095; B41J 13/0027

See application file for complete search history.

(56) References Cited

U.S. PATENT DOCUMENTS

| | | | | |
|---|---|---|---|---|
| 5,995,130 | A | 11/1999 | Akatsu et al. | |
| 2002/0081132 | A1 | 6/2002 | Miyamoto et al. | |
| 2002/0131804 | A1 | 9/2002 | Nakazawa et al. | |
| 2003/0039496 | A1 | 2/2003 | Miyamoto et al. | |
| 2003/0185608 | A1 | 10/2003 | Miyamoto et al. | |
| 2005/0174379 | A1 | 8/2005 | Nakazawa et al. | |
| 2011/0176851 | A1 | 7/2011 | Kuwana et al. | |
| 2013/0071169 | A1 | 3/2013 | Gouda et al. | |
| 2015/0367659 | A1* | 12/2015 | Katerberg | B41J 2/2135 347/16 |
| 2016/0121602 | A1* | 5/2016 | Nagasu | B41J 11/008 347/14 |
| 2017/0165960 | A1 | 6/2017 | Sunaoshi et al. | |
| 2017/0165961 | A1 | 6/2017 | Hayashi et al. | |
| 2017/0182764 | A1 | 6/2017 | Nagasu et al. | |
| 2018/0236794 | A1 | 8/2018 | Mizuno et al. | |
| 2018/0270366 | A1 | 9/2018 | Sunaoshi et al. | |

(Continued)

FOREIGN PATENT DOCUMENTS

| | | |
|---|---|---|
| JP | 2017-165094 | 9/2017 |

*Primary Examiner* — Julian D Huffman

(74) *Attorney, Agent, or Firm* — IPUSA, PLLC

(57) ABSTRACT

A conveyance apparatus includes a liquid discharge head unit, a conveyance rotator, and a plurality of detection devices. The liquid discharge head unit discharge liquid to an object conveyed in a conveyance direction. The conveyance rotator conveys the object. The plurality of detection devices output a detection result indicating a position of the object. The adjacent two of the plurality of detection devices are spaced at a prescribed distance. The prescribed distance is an integral multiple of a circumference of the conveyance rotator.

10 Claims, 24 Drawing Sheets

(56) References Cited

U.S. PATENT DOCUMENTS

| | | | |
|---|---|---|---|
| 2018/0272694 | A1 | 9/2018 | Gohda et al. |
| 2018/0361766 | A1 | 12/2018 | Shirato et al. |
| 2019/0143675 | A1 | 5/2019 | Nagasu et al. |
| 2020/0171816 | A1 | 6/2020 | Katoh et al. |
| 2020/0171846 | A1 | 6/2020 | Hayashi et al. |
| 2020/0171854 | A1 | 6/2020 | Sunaoshi et al. |
| 2020/0298596 | A1 | 9/2020 | Hayashi |
| 2021/0023837 | A1 | 1/2021 | Nagasu et al. |

* cited by examiner

CONVEYANCE APPARATUS AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-197559, filed on Nov. 27, 2020, in the Japan Patent Office, the entire disclosure of which is hereby incorporated by reference herein.

BACKGROUND

Technical Field

Embodiments of the present disclosure relate to a conveyance apparatus and an image forming apparatus.

Description of the Related Art

A configuration is known in which a plurality of liquid discharge head units discharge liquid onto a to-be-conveyed object at different positions in a conveyance direction of the object.

Further, a configuration is disclosed in which a plurality of liquid discharge head units is moved based on the displacement information of a to-be-conveyed object detected at a position separated from a conveyance rotator such as a conveyance roller that conveys the object and a landing position at which liquid lands on the object by an integral multiple of a circumference of a conveyance roller.

SUMMARY

In an embodiment of the present disclosure, a conveyance apparatus includes a liquid discharge head unit, a conveyance rotator, and a plurality of detection devices. The liquid discharge head unit discharge liquid to an object conveyed in a conveyance direction. The conveyance rotator conveys the object. The plurality of detection devices output a detection result indicating a position of the object. The adjacent two of the plurality of detection devices are spaced at a prescribed distance. The prescribed distance is an integral multiple of a circumference of the conveyance rotator.

In another embodiment of the present disclosure, an image forming apparatus includes the conveyance apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
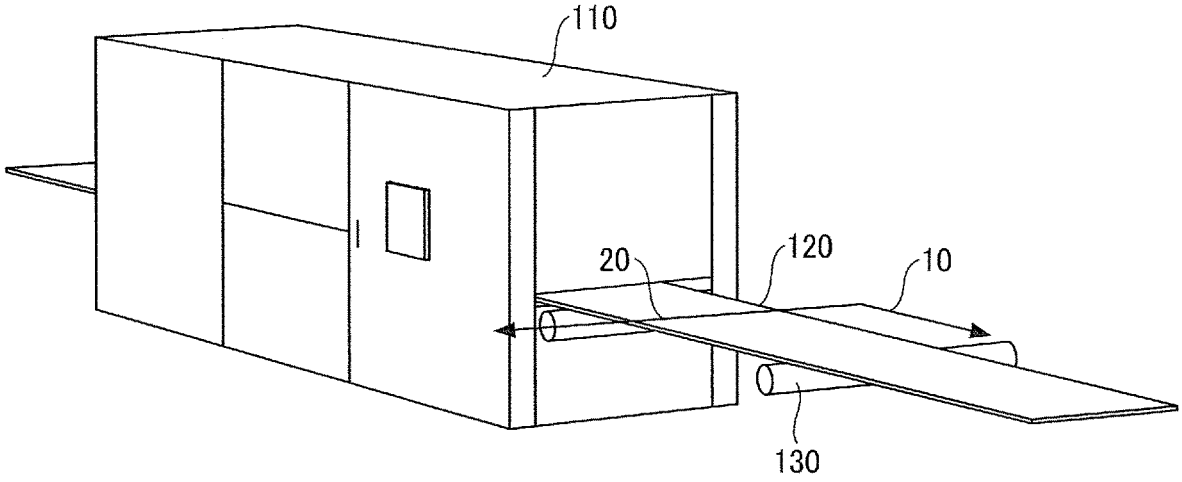
FIG. 1 is a perspective view of a conveyance apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure are described with reference to the accompanying drawings. In this specification and the drawings, components having substantially the same configurations and functions are denoted by the same reference numerals, and redundant description thereof will be omitted.

FIG. 1 is a perspective view of a conveyance apparatus according to an embodiment of the present disclosure.

For example, the conveyance apparatus may be an image forming apparatus 110 as illustrated in FIG. 1. In such an image forming apparatus 110, discharged liquid is a recording liquid such as an aqueous or oily ink. Hereinafter, cases in which the conveyance apparatus is the image forming apparatus 110 are described.

A to-be-conveyed object is, for example, a recording medium. In the present embodiment described with reference to FIG. 1, the image forming apparatus 110 discharges liquid onto a web 120, which serves as a recording medium conveyed by, for example, a roller 130, to form an image. For example, the web 120 is a so-called continuous sheet print medium. In other words, the web 120 is, for example, a roll-shaped sheet that can be wound up.

Thus, the image forming apparatus 110 is a so-called production printer. In the following description, cases in which a roller 130 adjusts, for example, the tension of the web 120 and the web 120 is conveyed in a conveyance direction 10 as illustrated in FIG. 1 are described. In the present embodiment described with reference to FIG. 1, a direction orthogonal to the conveyance direction 10 is referred to as an orthogonal direction 20.

In the present embodiment, the image forming apparatus 110 is an inkjet printer that discharges four color inks of black (K), cyan (C), magenta (M), and yellow (Y) to form an image at a predetermined position of the web 120. Accordingly, in the following description, cases in which the liquid is ink are described.

Figure 2:
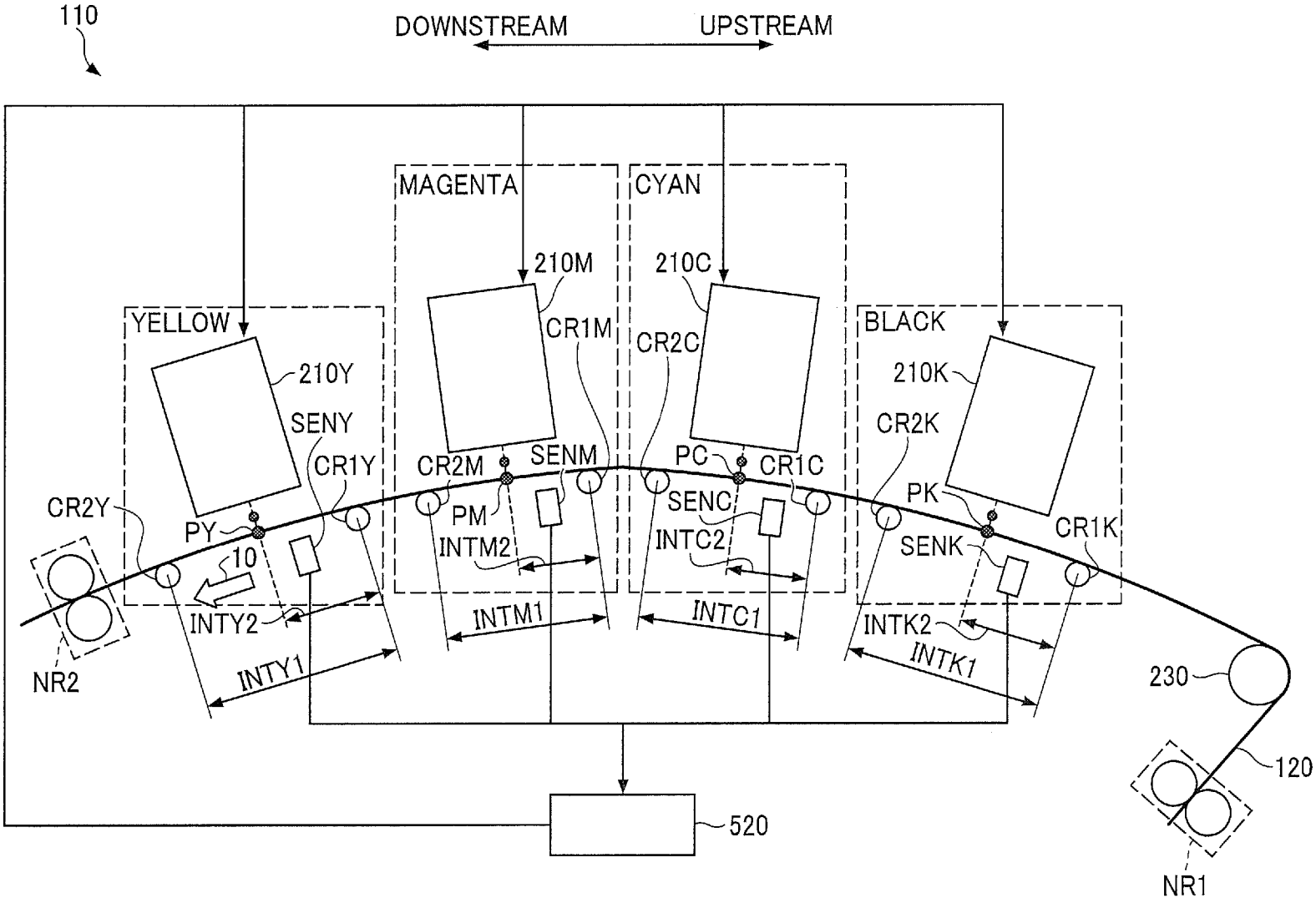
FIG. 2 is a diagram of an overall configuration of a conveyance apparatus, according to an embodiment of the present disclosure.

FIG. 2 is a diagram of an overall configuration of the conveyance apparatus according to the present embodiment.

As illustrated in FIG. 2, the image forming apparatus 110 has four liquid discharge head units (210K, 210C, 210M, and 210Y) to discharge ink of four colors. As described above, the liquid discharge head units 210K, 210C, 210M, and 210Y discharge the liquid of each color onto the web 120 conveyed in the conveyance direction 10.

The web 120 is conveyed by, for example, two pairs of nip rollers and a roller 230. Hereinafter, one of the two pairs of the nip rollers that are disposed upstream from the four liquid discharge head units 210K, 210C, 210M, and 210Y is referred to as a "first pair of nip rollers NR1." On the other hand, the other pair of nip rollers that are disposed downstream from the first pair of nip rollers NR1 and the liquid discharge head units 210K, 210C, 210M, and 210Y is referred to as a "second pair of nip rollers NR2." As illustrated in FIG. 2, each of the two pairs of the nip rollers rotates while nipping a to-be-conveyed object such as the web 120. As described above, the two pairs of nip rollers and the roller 230 make up a conveyance mechanism to convey, for example, the web 120 in a predetermined direction.

The recording medium is preferably long. More specifically, the recording medium is preferably longer than the distance between the first pair of nip rollers NR1 and the second pair of rollers NR2. Further, the recording medium is not limited to the web 120. In other words, the recording medium may be a sheet that is folded and stored, such as a so-called Z-fold sheet.

Hereinafter, in the overall configuration of the conveyance apparatus illustrated in FIG. 2, the liquid discharge head units 210K, 210C, 210M, and 210Y are disposed in the order of black (K), cyan (C), magenta (M), and yellow (Y) in an upstream to downstream direction. The liquid discharge head unit that is disposed most upstream in the conveyance direction 10 is referred to as a black liquid discharge head unit 210K, and is used for black (K) ink. The liquid discharge head unit that is disposed next to the black liquid discharge head unit 210K is referred to as a cyan liquid discharge head unit 210C, and is used for cyan (C) ink. Further, the liquid discharge head unit that is disposed next to the cyan liquid discharge head unit 210C is referred to as a magenta liquid discharge head unit 210M, and is used for magenta (M) ink. Subsequently, the liquid discharge head unit that is disposed most downstream in the conveyance direction 10 is hereinafter referred to as a yellow liquid discharge head unit 210Y, and is used for yellow (Y) ink.

Each of the liquid discharge head units 210K, 210C, 210M, and 210Y discharges ink of the corresponding color to a predetermined corresponding position of the web 120 based on, for example, image data.

As described above, the positions at which ink is discharged is substantially equal to positions at which the liquid discharged from the liquid discharge head units 210K, 210C, 210M, and 210Y lands on the recording medium. Such positions at which ink is discharged are referred to as landing positions in the following description. In other words, each of the landing positions is directly below the corresponding one of the liquid discharge head units 210K, 210C, 210M, and 210Y.

In the above-described example, the black ink is discharged to a landing position (hereinafter referred to as a "black ink landing position PK") of the black liquid discharge head unit 210K. The cyan ink is discharged to a landing position (hereinafter referred to as a "cyan ink landing position PC") of the cyan liquid discharge head unit 210C in a similar manner. Further, the magenta ink is discharged to a landing position (hereinafter referred to as "magenta ink landing position PM") of the magenta liquid discharge head unit 210M. The yellow ink for is discharged to a landing position (hereinafter, referred to as a "yellow ink landing position PY") of the yellow liquid discharge head unit 210Y.

The timing at which each of the liquid discharge head units 210K, 210C, 210M, and 210Y discharges ink is controlled by a controller 520 connected to each of the liquid discharge head units 210K, 210C, 210M, and 210Y.

Further, in the image forming apparatus 110, desirably a plurality of rollers are provided for each of the liquid discharge head units 210K, 210C, 210M, and 210Y. More specifically, as illustrated in FIG. 2, desirably the multiple rollers are disposed at positions upstream from the liquid discharge head units 210K, 210C, 210M, and 210Y and at positions downstream from the liquid discharge head units 210K, 210C, 210M, and 210Y in the conveyance direction 10, respectively.

In the present embodiment described with reference to FIG. 2, for each of the liquid discharge head units 210K, 210C, 210M, and 210Y, a roller (hereinafter, referred to as a first roller) that is used to convey the web 120 to the corresponding one of the landing positions is provided at an upstream position of the corresponding one of the liquid discharge head units 210K, 210C, 210M, and 210Y.

In addition, a plurality of rollers that are referred to as second rollers in the following description and are used to convey the web 120 downstream in the conveyance direction 10 from the landing positions are disposed at positions downstream from the liquid discharge head units 210K, 210C, 210M, and 210Y.

As described above, when the first rollers and the second rollers that serve as conveyance rotators are installed, so-called flapping can be reduced at each of the landing positions. The first rollers and the second rollers are used to convey the recording medium, and are, for example, driven rollers. The first rollers and the second rollers may be rollers that are rotationally driven by, for example, a motor.

More specifically, a first roller CR1K for black, which is used to convey the web 120 to the black ink landing position PK, is disposed to discharge the black ink at a predetermined position of the web 120. Moreover, a second roller CR2K for black is disposed to convey the web 120 downstream from the black ink landing position PK.

A first roller CR1C for cyan and a second roller CR2C for cyan are installed for the cyan liquid discharge head unit 210C in a similar manner. Further, a first roller CR1M for magenta and a second roller CR2M for magenta are installed for the magenta liquid discharge head unit CR2M. In addition, a first roller CR1Y for yellow and a second roller CR2Y for yellow are installed for the yellow liquid discharge head unit CR2Y.

Figure 3A:
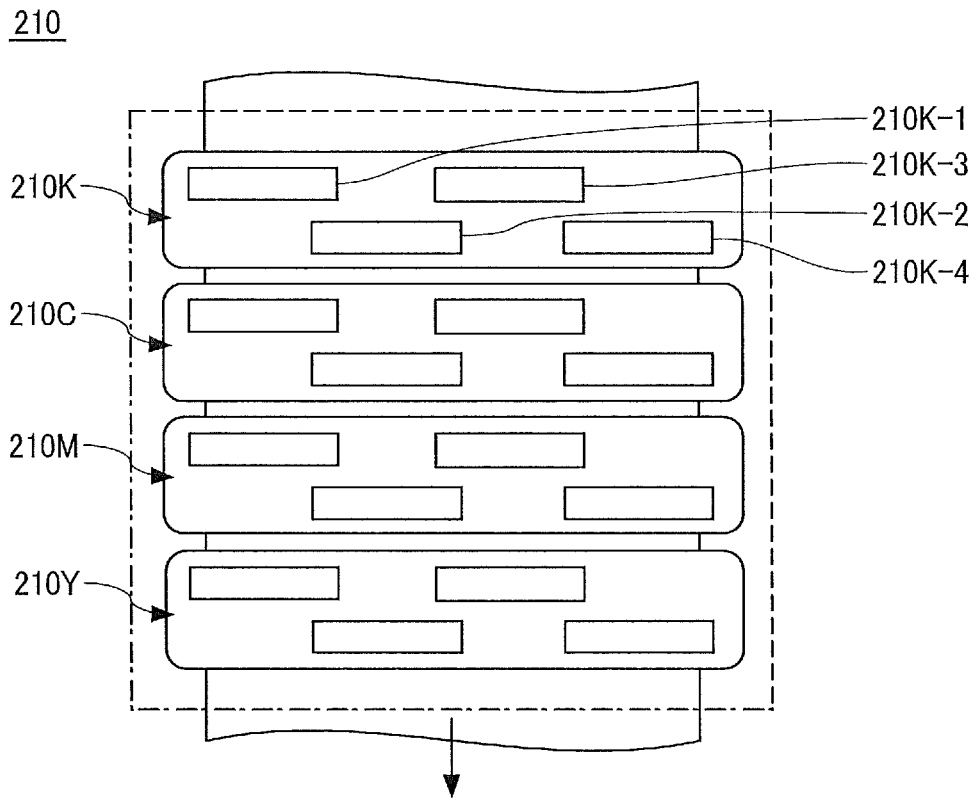
FIG. 3A is a view of a plurality of liquid discharge head units provided for a conveyance apparatus, according to an embodiment of the present disclosure.
Figure 3B:
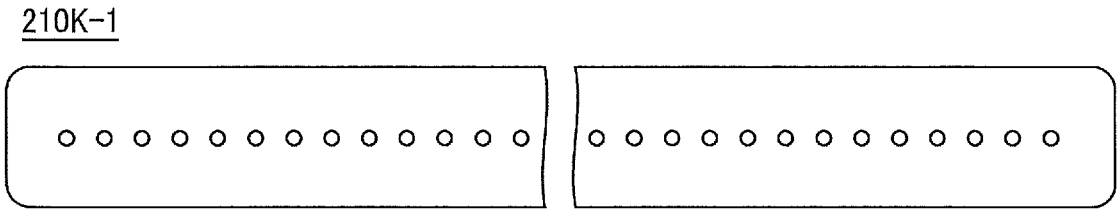
FIG. 3B is a view of a discharge head included in one of the multiple liquid discharge head units of FIG. 3A.

FIG. 3A is a schematic plan view of the liquid discharge head unit 210 including a plurality of liquid discharge head units 210K, 210C, 210M, and 210Y provided for the conveyance apparatus according to the present embodiment. FIG. 3B is a plan view of a discharge head 210K-1 included in the black liquid discharge head unit 210K of FIG. 3A.

FIG. 3A is a schematic plan view of the black liquid discharge head unit 210K, the magenta liquid discharge head unit 210M, the cyan liquid discharge head unit 210C, and the yellow liquid discharge head unit 210Y provided for the image forming apparatus 110. As illustrated in FIGS. 3A and 3B, the liquid discharge head units 210K, 210C, 210M, and 210Y are, for example, line-type head units. In other words, the image forming apparatus 110 includes the four liquid discharge head units 210K, 210C, 210M, and 210Y corresponding to black (K), cyan (C), magenta (M), and yellow (Y) respectively from upstream in the conveyance direction 10.

For example, in the black liquid discharge head unit 210K, four heads 210K-1, 210K-2, 210K-3, and 210K-4 are arranged in a zigzag manner in the orthogonal direction 20. Accordingly, the image forming apparatus 110 can form an image over the entire area in the width direction, i.e., the orthogonal direction 20 of the image formation region or print region. The configurations of the other liquid discharge head units 210C, 210M, and 210Y are the same as the configuration of the liquid discharge head unit 210K for black (K). Thus, the description thereof will be omitted.

In the present embodiment, cases in which the liquid discharge head unit 210 includes four heads are described. However, no limitation is indicated thereby, and the liquid discharge head unit 210 may include a single head.

A sensor that serves as a detection device is installed for each of the liquid discharge head units 210K, 210C, 210M, and 210Y. A light emitting diode (LED), or an optical sensor using light such as laser, air pressure, photoelectric, ultrasonic wave, or infrared ray is employed as the sensor.

The recording medium is irradiated with light projected from a light source such as the LED, and the surface of the recording medium is captured by the sensor. Such a configuration as described above allows to detect a pattern (hereinafter, referred to as surface pattern) generated by projecting light on the unevenness on the surface of the recording medium. The surface pattern is different for each position on the surface of the recording medium, for example, a displacement of the web 120 can be detected by detecting the same surface pattern.

The optical sensor may be, for example, a charge coupled device (CCD) camera or a complementary metal oxide semiconductor (CMOS) camera. The sensor may be, for example, a sensor capable of detecting an edge of the recording medium.

Returning to FIG. 2, in the following description, a detection device installed for the black liquid discharge head unit 210K is referred to as a sensor SENK for black.

In a similar manner, a detection device installed for the cyan liquid discharge head unit 210C is referred to as a sensor SENC for cyan. Further, a detection device installed for the magenta liquid discharge head unit 210M is referred to as a sensor SENM for magenta. Furthermore, a detection device installed on the yellow liquid discharge head unit 210Y is referred to as a sensor SENY for yellow.

In the following description, the sensor SENK for black, the sensor SENC for cyan, the sensor SENM for magenta, and the sensor SENY for yellow may be collectively referred to simply as sensors.

Further, in the following description, a position at which the sensor is installed refers to a position at which, for example, detection is performed. For this reason, it is not necessary to install all devices constituting the detection device at the positions at which the sensors are installed, and the devices other than the sensor may be connected, for example, with cables and disposed at other positions.

In the present embodiment, the sensor SENK for black, the sensor SENC for cyan, the sensor SENM for magenta, and the sensor SENY for yellow are disposed at positions as illustrated in FIG. 2.

As described above, desirably, the position at which each of the sensors is installed is a position close to the corresponding one of the landing positions. If each of the sensors is installed near the corresponding one of the landing positions, the distance between the landing position and the sensor is short. When the distance between the landing position and the sensor is short, an error in detection can be reduced. Accordingly, the sensors allows the image forming apparatus 110 to accurately detect the positions of the recording medium.

Specifically, the position close to the landing position is between the first roller and the second roller. In other words, desirably, the position at which the sensor SENK for black is installed is within an INTK1 between the first roller CR1K for black and the second roller CR2K for black as illustrated in FIG. 2.

In a similar manner, desirably, the position at which the sensor SENC for cyan is installed is within an INTC1 between the first roller CR1C for cyan and the second roller CR2C for cyan as illustrated in FIG. 2. In a similar manner, desirably, the position at which the sensor SENC for magenta is installed is within an INTM1 between the first roller CR1M for magenta and the second roller CR2M for magenta as illustrated in FIG. 2. Further, desirably, the position at which the sensor SENY for yellow is installed is within an INTY1 between the first roller CR1Y for yellow and the second roller CR2Y for yellow as illustrated in FIG. 2.

As described above, when each of the sensors is installed between the corresponding pair of rollers, each of the sensors can detect, for example, the position of the recording medium at a position close to the corresponding one of the landing positions. In many cases, the conveyance speed is relatively stable when the recording medium is placed between the rollers. Accordingly, the image forming apparatus 110 can accurately detect the position of the recording medium.

Further, desirably the position at which each of the sensors is disposed is a position closer to the corresponding one of the first rollers than the corresponding one of the landing positions between the rollers. In other words, desirably the position at which each of the sensors is disposed is upstream from the corresponding one of the landing positions in the conveyance direction 10.

More specifically, desirably the position at which the sensor SENK for black is disposed is within an area between the black ink landing position PK and the position at which the first roller CR1K for black is installed toward upstream from the black ink landing position PK. Such an area between the black ink landing position PK and the first roller CR1K may be referred to as an upstream section INTK2 for black in the following description.

In a similar manner, desirably the position at which the sensor SENC for cyan is disposed is within an area between the cyan ink landing position PC and the position at which the first roller CR1C for cyan is disposed upstream from the cyan ink landing position PC. Such an area between the cyan ink landing position and the first roller CR1C may be referred to as an upstream section INTC2 for cyan in the following description.

Further, desirably the position at which the sensor SENM for magenta is disposed is within an area between the magenta landing position PM and the position at which the first roller CR1M for magenta is disposed upstream from the magenta ink landing position PM. Such an area between the magenta ink landing position and the first roller CR1M may be referred to as an upstream section INTM2 for magenta in the following description.

In a similar manner, desirably the position at which the sensor SENY for yellow is disposed is within an area between the yellow landing position PY and the position at which the first roller CR1Y for yellow is disposed upstream from the yellow ink landing position PY. Such an area between the yellow ink landing position and the first roller CR1Y may be referred to as an upstream section INTY2 for yellow in the following description.

When the sensor SENK for black, the sensor SENC for cyan, the sensor SENM for magenta, and the sensor SENY for yellow are installed in the upstream section INTK2 for black, the upstream section INTC2 for cyan, the upstream section INTM2 for magenta, and the upstream section INTY2 for yellow, respectively, the image forming apparatus 110 can accurately detect the position of the recording medium.

When the sensor SENK for black, the sensor SENC for cyan, the sensor SENM for magenta, and the sensor SENY for yellow are disposed at the above-described positions, the sensors are disposed at positions upstream from the respective landing positions. For this reason, first, the image forming apparatus 110 can accurately detect the position of the recording medium with the sensors at the upstream positions and can calculate the liquid discharge timing of each of the liquid discharge head units 210K, 210C, 210M, and 210Y In other words, when the web 120 is conveyed downstream in the conveyance direction 10 while, for example, the above-described calculation is performed, the liquid discharge head units 210K, 210C, 210M, and 210Y can discharge the liquid at the calculated timing.

If the each of the sensors is provided at a position immediately below the corresponding one of the liquid discharge head units 210K, 210C, 210M, and 210Y, undesired color shift may occur due to, for example, a delay corresponding to the control operation. For this reason, when the position at which each of the sensors is disposed is upstream from the landing position in the conveyance direction 10, the image forming apparatus 110 can reduce the color misalignment and enhance the image quality.

There is a case in which installing, for example, a sensor near the landing position is restricted. For this reason, desirably the position at which each of the sensors is disposed is a position closer to the corresponding one of the first rollers than the corresponding one of the landing positions.

However, the position of the each of the sensors may be directly below the corresponding one of the liquid discharge head units 210K, 210C, 210M, and 210Y. In the following description, cases in which each of the sensors is directly below the corresponding one of the liquid discharge head units 210K, 210C, 210M, and 210Y are described with reference to the accompanying drawings. As in this case, when each of the sensors is directly below the corresponding one of the liquid discharge head units 210K, 210C, 210M, and 210Y, an accurate amount of movement of the to-be-conveyed object directly below the each of the sensors can be detected by the sensors. Further, in this case, the position of each of the sensors and the corresponding one of the landing positions substantially coincide with each other.

Accordingly, if, for example, the control operation can be performed quickly, desirably, each of the sensors is located closer to the position immediately below the corresponding one of the liquid discharge head units 210K, 210C, 210M, and 210Y. On the other hand, each of the sensors do not have to be directly below the corresponding one of the liquid discharge head units 210K, 210C, 210M, and 210Y, and the calculation is performed in a similar manner even when each of the sensors is not directly below the corresponding one of the liquid discharge head units 210K, 210C, 210M, and 210Y.

In addition, if the detection error is allowable, the position of each of the sensors may be a position immediately below the corresponding one of the liquid discharge head units 210K, 210C, 210M, and 210Y or a position between the respective first roller and the respective second roller and on a position downstream from immediately below the corresponding one of the liquid discharge head units 210K, 210C, 210M, and 210Y.

Figure 4A:
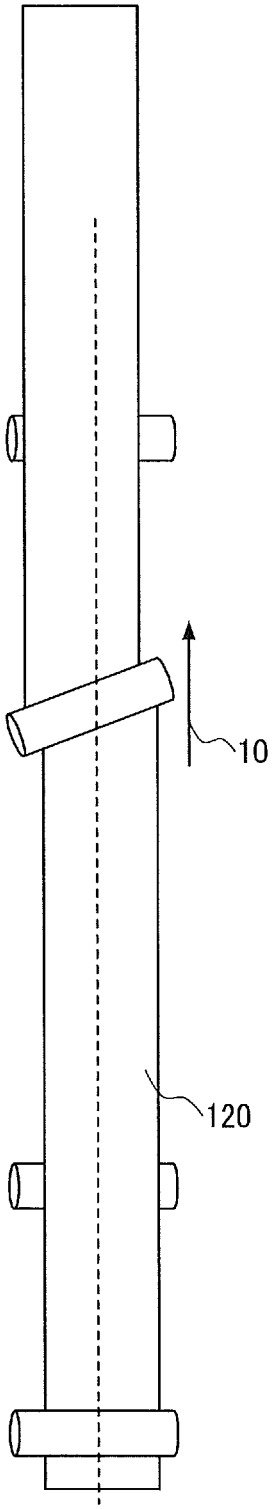
FIGS. 4A and 4B are diagrams illustrating cases in which displacements occurs to a web as a to-be-conveyed object, according to an embodiment of the present disclosure.
Figure 4B:
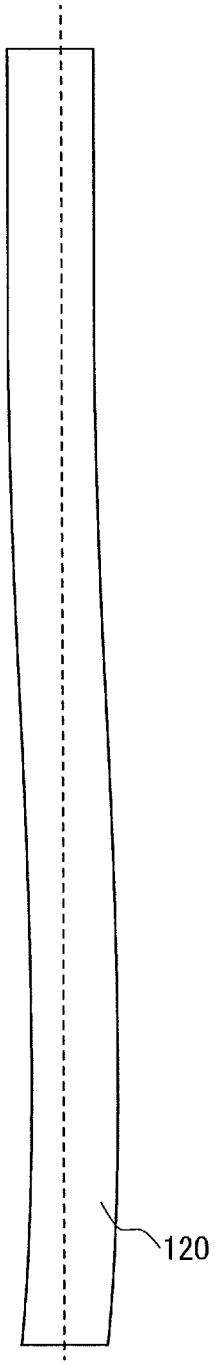

FIGS. 4A and 4B are diagrams illustrating cases in which the to-be-conveyed object displacements occur to the web 120, according to the present embodiment.

Hereinafter, cases in which the web 120 is conveyed in the conveyance direction 10 as illustrated in FIG. 4A are described. In the present embodiment, the web 120 is conveyed by, for example, rollers. When the web 120 is conveyed in the above-described manner, the web 120 is positionally shifted in the orthogonal direction 20 as illustrated, for example, in FIG. 4B. That is, the web 120 may meander as illustrated in FIG. 4B.

In the present embodiment described with reference to FIG. 4A, one of the rollers is obliquely arranged. In FIG. 4A, the state in which the one of the rollers is obliquely arranged is described for easy understanding. However, the inclination of the roller may be smaller than the state illustrated in FIG. 4B.

The displacement of the web 120, in other words, the meandering occurs due to, for example, eccentricity or misalignment of a roller related to conveyance, or cutting of the web 120 by a blade. In addition, in a case in which the width of the web 120 is, for example, narrow with respect to the orthogonal direction 20, for example, thermal expansion of the roller may affect the displacement of the web 120 in the orthogonal direction 20.

For example, if vibration occurs, for example, due to eccentricity of a roller or cutting of the web 120 by the blade, the web 120 may meander as illustrated in FIG. 4B. In addition, the web 120 may meander as illustrated in FIG. 4B due to the physical characteristics of the web 120, i.e., the shape of the web 120 after the web 120 has been cut by the blade and cuts of the web 120 are not uniform.

Figure 5:
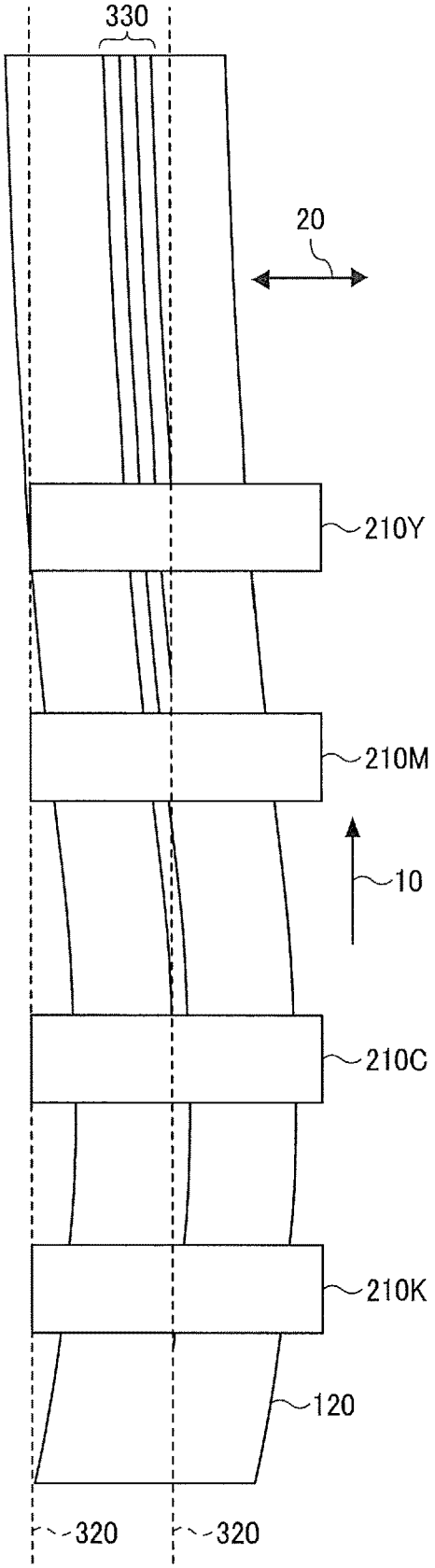
FIG. 5 is a diagram illustrating a cause of undesired color shift on a web, according to an embodiment of the present disclosure.

FIG. 5 is a view illustrating of a cause of undesired color shift on the web 120, according to the present embodiment.

As described with reference to FIGS. 4A and 4B, when the displacement of the web 120 occurs in the orthogonal direction 20, in other words, meandering of the web 120 occurs, undesired color shift on the web 120 is likely to occur due to the cause as illustrated in FIG. 5.

Specifically, in a case in which an image is formed on a recording medium using a plurality of colors, in other words, in a case in which a color image is formed, as illustrated in FIG. 5, the image forming apparatus 110 overlaps the ink of the multiple colors discharged by the respective liquid discharge head units (210K, 210C, 210M, or 210Y) and so-called color planes to form a color image on the web 120.

In the above-described case illustrated in FIG. 5, the displacement of the web 120 as described with reference to FIGS. 4A and 4B may occur. For example, the meandering of the web 120 may occur with reference to the reference lines 320. In this case, when each of the liquid discharge head units 210K, 210C, 210M, and 210Y discharges ink to the same position, if the displacement of the web 120 occurs in the orthogonal direction 20 due to the meandering between the liquid discharge head units 210K, 210C, 210M, and 210Y, color shift 330 may occur.

In other words, the color shift 330 is caused by the displacement of the web 120. When the color shift 330 occurs as described above, the image quality of the image formed on the web 120 may deteriorate.

For example, the controller 520 has a configuration as described below.

Figure 6:
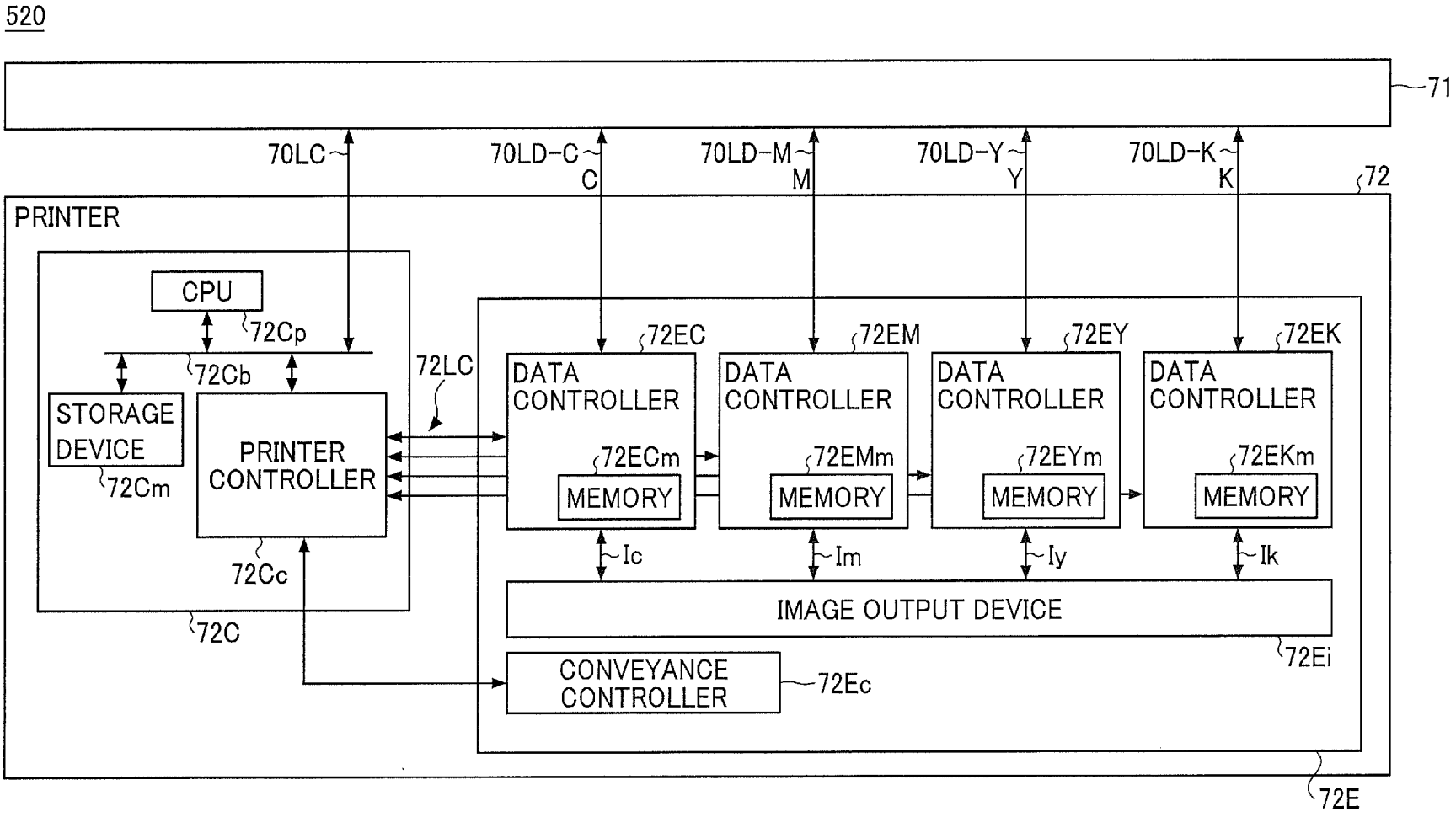
FIG. 6 is a diagram illustrating a hardware configuration of a controller provided for a conveyance apparatus, according to an embodiment of the present disclosure.

FIG. 6 is a diagram illustrating a hardware configuration of the controller 520 provided for the conveyance apparatus, according to the present embodiment.

For example, the controller 520 includes a host device 71, which is, for example, an information processing device and a printer 72. In the present embodiment described with reference to FIG. 6, the controller 520 causes the printer 72 to form an image on a recording medium based on image data and control data input from the host device 71.

The host device 71 is, for example, a personal computer (PC). The printer 72 includes a printer controller 72C and a printer engine 72E.

The printer controller 72C controls the operation of the printer engine 72E. First, the printer controller 72C transmits and receives control information to and from the host device 71 via a control line 70LC. Further, the printer controller 72C transmits and receives the control information to and from the printer engine 72E via the control line 70LC. When various print conditions and the like indicated by the control information are input to the printer controller 72C via transmission and reception of the control data as described above, the printer controller 72C stores, for example, print conditions in, for example, a register. In addition, the printer controller 72C transmits and receives the control data to and from the printer engine 72E via the control line 70LC and performs image formation according to print job data, i.e., the control data.

The printer controller 72C includes a CPU 72Cp, a print controller 72Cc, and a storage device 72Cm. The CPU 72Cp and the print controller 72Cc are connected via a bus 72Cb and communicate with each other. The bus 72Cb is connected to the control line 70LC via, for example, a communication interface (I/F).

The CPU 72Cp controls the overall operation of the printer 72 by, for example, a control program. In other words, the CPU 72Cp is an arithmetic device and a controller.

The print controller 72Cc transmits and receives commands or status information to and from the printer engine 72E based on the control data sent from the host device 71. Thus, the print controller 72Cc controls the printer engine 72E.

A plurality of data lines, i.e., data lines TOLD-C, TOLD-M, TOLD-Y, and TOLD-K are connected to the printer engine 72E. The printer engine 72E receives the image from the host device 71 via the multiple data lines. Next, the printer engine 72E forms an image of each color under the control of the printer controller 72C.

The printer engine 72E includes a plurality of data controllers 72EC, 72EM, 72EY, and 72EK. In addition, the printer engine 72E includes an image output device 72Ei and a conveyance controller 72Ec.

Figure 7:
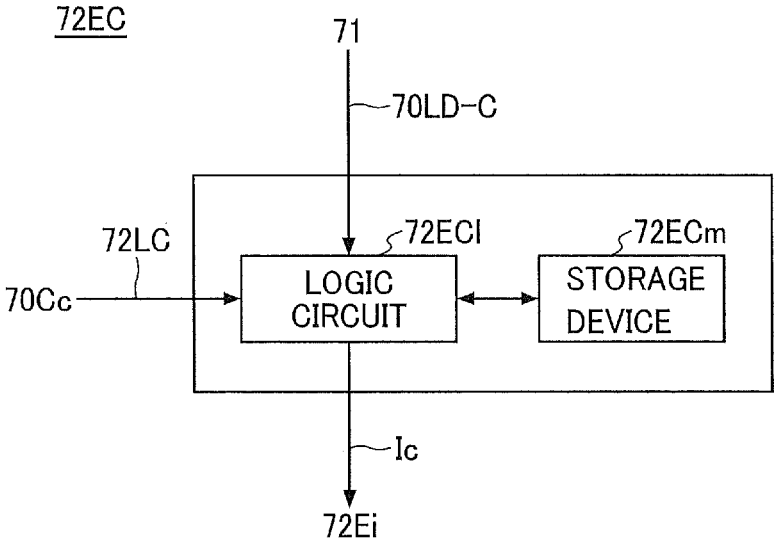
FIG. 7 is a diagram illustrating a configuration of a data controller provided for a conveyance apparatus, according to an embodiment of the present disclosure.

FIG. 7 is a diagram illustrating a configuration of a data controller 72EC provided for the image forming apparatus 110, according to the present embodiment.

The multiple data controllers 72EC, 72EM, 72EY, and 72EK have a same configuration. Hereinafter, cases in which the data controllers 72EC, 72EM, 72EY, and 72EK have the same configuration are described. In FIG. 7, and the data controller 72EC is illustrated. Accordingly, redundant description of the data controllers 72EC, 72EM, 72EY, and 72EK is omitted.

The data controller 72EC includes a logic circuit 72EC1 and a storage device 72ECm. As illustrated in FIG. 7, the logic circuit 72EC1 is connected to the host device 71 via the data line TOLD-C. The logic circuit 72EC1 is connected to the print controller 72Cc via the control line 72LC. The logic circuit 72EC1 includes, for example, an application-specific integrated circuit (ASIC), a programmable logic device (PLD).

The logic circuit 72EC1 stores the image data input from the host device 71 in the storage device 72ECm based on a control signal input from the printer controller 72C.

The logic circuit 72EC1 reads cyan image data Ic from the storage device 72ECm based on a control signal input from the printer controller 72C. Next, the logic circuit 72EC1 sends the read cyan image signal Ic to the image output device 72Ei.

Preferably, the storage device 72ECm has a capacity capable of storing about three pages of image data. When the image data of about three pages can be stored, the storage device 72ECm can store image data input from the host device 71, image data during image formation, and image data for an image to be formed next.

Figure 8:
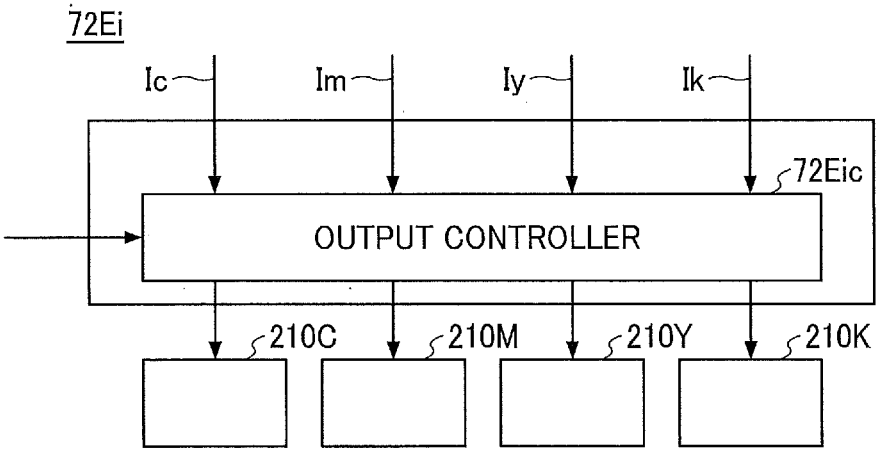
FIG. 8 is a diagram illustrating a configuration of an image output device provided for a conveyance apparatus, according to an embodiment of the present disclosure.

FIG. 8 is a diagram illustrating a configuration of the image output device 72Ei provided for the image forming apparatus 110, according to the present embodiment.

As illustrated in FIG. 8, the image output device 72Ei includes an output controller 72Eic, the black liquid discharge head unit 210K, the cyan liquid discharge head unit 210C, the magenta liquid discharge head unit 210M, and the yellow liquid discharge head unit 210Y which are liquid discharge head units of respective colors.

The output controller 72Eic outputs the image data of four colors to the respective liquid discharge head units (210K, 210C, 210M, and 210Y). In other words, the output controller 72Eic controls each of the liquid discharge head units 210K, 210C, 210M, and 210Y of the respective color based on the input image data.

The output controller 72Eic controls the multiple liquid discharge head units 210K, 210C, 210M, and 210Y simultaneously or individually. In other words, the output controller 72Eic receives the input of a timing data, and performs, for example, control for changing the timing at which the liquid is discharged to the liquid discharge head unit 210.

The output controller 72Eic may control any one of the liquid discharge head units 210K, 210C, 210M, and 210Y based on a control signal input from the printer controller 72C. Further, the output controller 72Eic may control any one of the liquid discharge head units 210K, 210C, 210M, and 210Y based on, for example, an operation by the user.

The printer 72 includes a path through which image data is input from the host device 71 and a path used for transmission and reception between the host device 71 and the printer 72 based on control data. Each of the paths is different from each other.

In addition, the printer 72 may form an image using only one color, such as black. When an image is formed using a single color of black, for example, the printer 72 may include one data controller (72EC, 72EM, 72EY, and 72EK) and four black liquid discharge head units to increase the speed of image formation. Such a configuration as described above allows each of the multiple black liquid discharge head units to discharge black ink. Accordingly, image formation can be performed faster than in a configuration in which one black liquid discharge head unit 210K is provided.

The conveyance controller 72Ec includes, for example, a motor, a mechanism, a driver device for conveying the web 120. For example, the conveyance controller 72Ec controls, for example, a motor connected to, for example, each of the rollers to convey the web 120.

Figure 9:
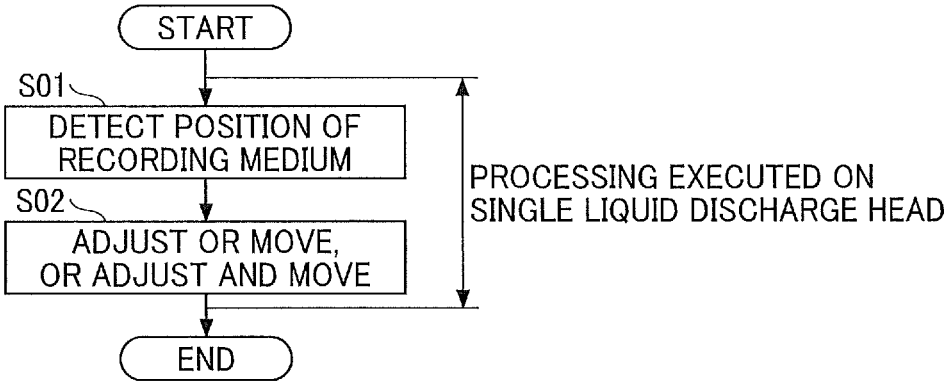
FIG. 9 is a flowchart of overall processing executed by a conveyance apparatus, according to an embodiment of the present disclosure.

FIG. 9 is a flowchart of an overall processing executed by the conveyance apparatus, according to the present embodiment.

For example, image data indicating an image to be formed on the web 120 is input to the image forming apparatus 110 in advance. Next, the image forming apparatus 110 performs processing based on the image data and forms an image represented by the image data on the web 120.

The processes as illustrated in FIG. 9 indicate the processes for one of the liquid discharge head units 210K, 210C, 210M, and 210Y In other words, for example, in the present embodiment described with reference to FIG. 2, the processing is for the black liquid discharge head unit 210K. In addition, for example, the processing illustrated in FIG. 9 is separately performed in parallel or in tandem for the liquid discharge head units of other colors.

In step S01, the image forming apparatus 110 detects the position of the recording medium in the conveyance direction 10, the orthogonal direction 20, or both in the conveyance direction 10 and the orthogonal direction 20. In other words, in step S01, the image forming apparatus 110 detects the position of the web 120 by sensors.

In step S02, the image forming apparatus 110 corrects control of discharge by the liquid discharge head unit 210, moves the liquid discharge head unit 210 relative to the web 120, or performs both the correction and movement.

Step S02 is performed based on the detection result of step S01. Further, in step S02, the liquid discharge head unit 210 is moved so as to compensate for the displacement of the web 120 indicated by the detection result of the step S01. For example, in step S01, the image forming apparatus 110 moves the liquid discharge head unit 210 in the orthogonal direction 20 to compensate for the displacement of the web 120 by the amount of the change in the position detected in step S02.

The image forming apparatus 110 may correct the timing at which the liquid discharge head unit 210 discharge the liquid to compensate for the displacement of the web 120. In a case in which the displacement of the web 120 is compensated for in both the conveyance direction 10 and the orthogonal direction 20, both correction of discharge timing and movement of the liquid discharge head unit 210 are performed. In which direction the liquid discharge head unit 210 is moved is determined by the direction in which the liquid discharge head unit 210 is moved.

Figure 10:
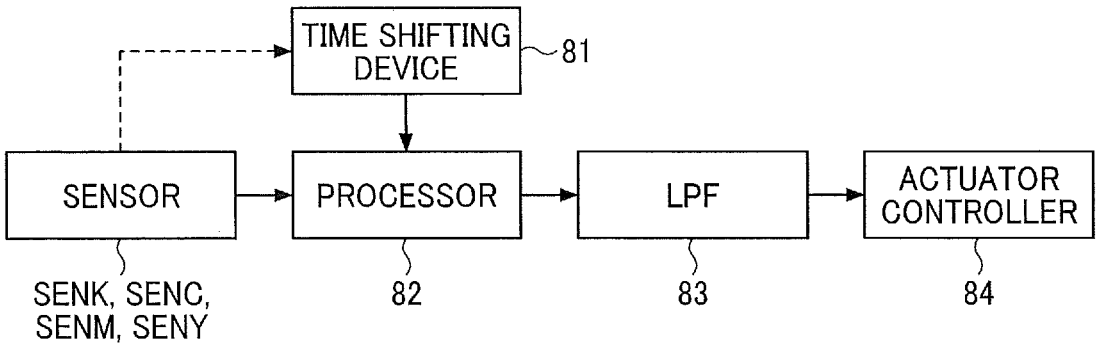
FIG. 10 is a block diagram illustrating a configuration in which an image forming apparatus moves a liquid discharge head unit, according to an embodiment of the present disclosure.

FIG. 10 is a block diagram illustrating a configuration in which the image forming apparatus 110 moves the liquid discharge head unit 210, according to the present embodiment.

For example, the image forming apparatus 110 includes a time shifting device 81, an arithmetic device 82, a low-pass filter (LPF) 83, and an actuator controller 84 in addition to the sensors.

The time shifting device 81 stores the detection result of the sensors and stores data indicating the position of the recording medium in one cycle before. In other words, the time shifting device 81 is a storage device.

The arithmetic device 82 subtracts the current position of the recording medium detected by the sensor from the position of the recording medium in one cycle before stored by the time shifting device 81 to calculate the change of the position of the recording medium. In other words, the arithmetic device 82 calculates a so-called meandering amount of the recording medium. In other words, the arithmetic device 82 is, for example, a CPU, or an electronic circuit.

The LPF 83 performs filter processing on the meandering amount of the recording medium calculated by the arithmetic device 82. Thus, the LPF 83 reduces a rapid change in the amount of the meandering of the recording medium. The range of the frequency of the meandering is determined to some extent by, for example, the conveyance speed of the recording medium. For this reason, the LPF 83 attenuates high-frequency values, i.e., values that exhibit abrupt changes, higher than predetermined meandering frequencies. Abrupt changes are often noise or false detections. For this reason, when the abrupt changes in the meandering amount is reduced by the LPF 83, the image forming apparatus 110 can reduce the malfunction of the actuator.

The actuator controller 84 controls an actuator that moves the liquid discharge head unit 210. For example, an object controlled by the actuator controller 84 is a moving mechanism as described below.

Figure 11:
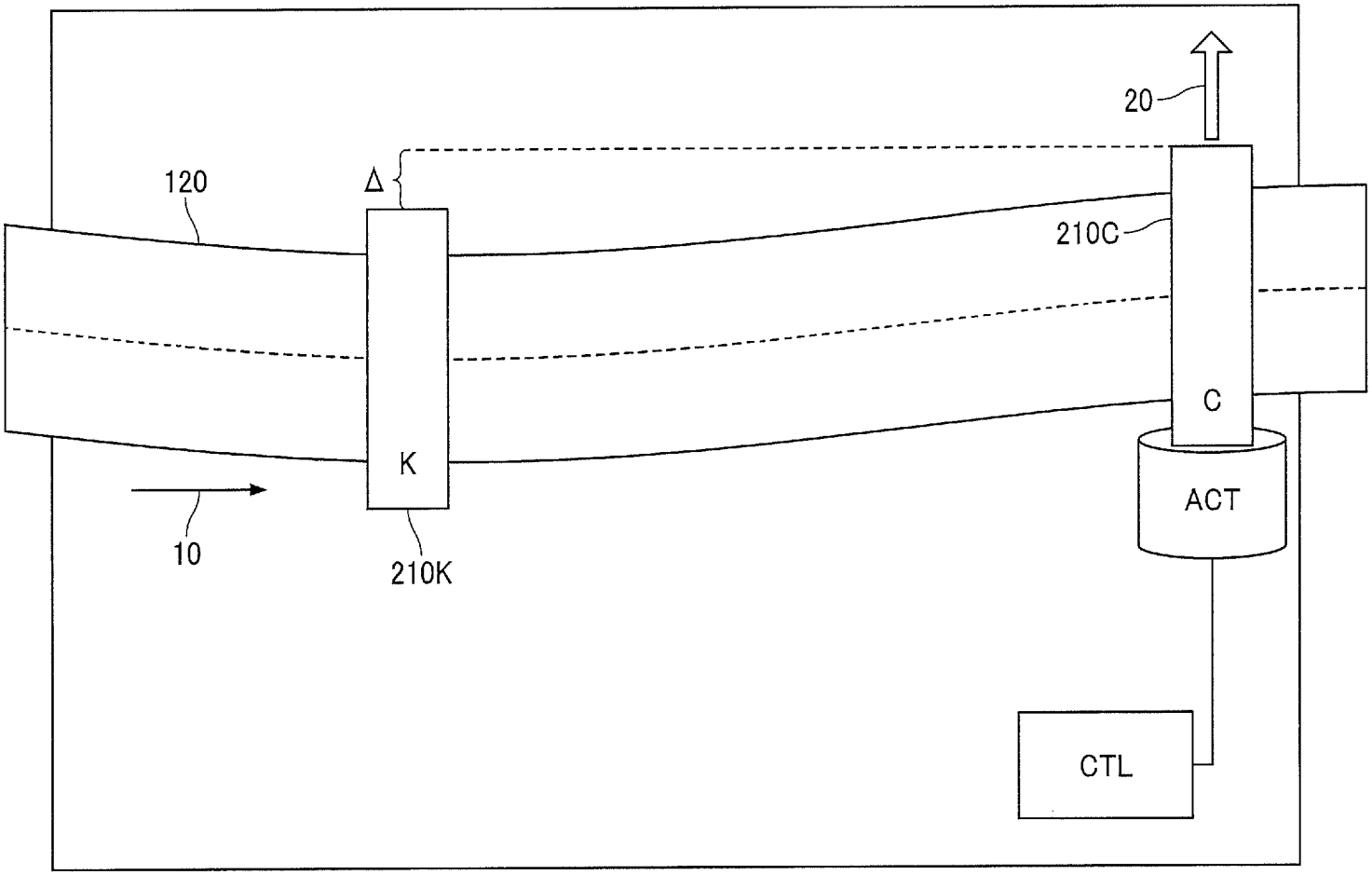
FIG. 11 is a diagram illustrating a mechanism for moving a cyan liquid discharge head unit, according to an embodiment of the present disclosure.

FIG. 11 is a diagram illustrating a mechanism for moving the cyan liquid discharge head unit 210C, according to the present embodiment.

For example, the actuator controller 84 is an actuator controller CTL in a configuration illustrated in FIG. 11, and controls the moving mechanism illustrated in FIG. 11. Hereinafter, a configuration in which the cyan liquid discharge head unit 210C according to the present embodiment is moved is described.

Firstly, in the present embodiment described with reference to FIG. 11, an actuator ACT such as a linear actuator for moving the cyan liquid discharge head unit 210C is installed with the cyan liquid discharge head unit 210C. The actuator controller CTL for controlling the actuator ACT is connected to the actuator ACT.

The actuator ACT is, for example, a linear actuator or a motor. The actuator ACT may include, for example, a control circuit, a power supply circuit, and mechanical components.

The actuator controller CTL is, for example, a driver circuit. The actuator controller CTL controls the position of the cyan liquid discharge head unit 210C.

The detection result in step S01 in FIG. 9 is input to the actuator controller CTL. Then, the actuator controller CTL causes the actuator ACT to move the cyan liquid discharge head unit 210C to compensate for the displacement of the web 120 indicated by the detection result (step S02).

In the present embodiment described with reference to FIG. 11, the detection result indicates, for example, displacement Δ. Accordingly, in the present embodiment, the actuator controller CTL moves the cyan liquid discharge head unit 210C in the orthogonal direction 20 so as to compensate for the displacement Δ.

The hardware of the controller 520 and devices illustrated in FIG. 11 may be integrated or may be separated.

Figure 12:
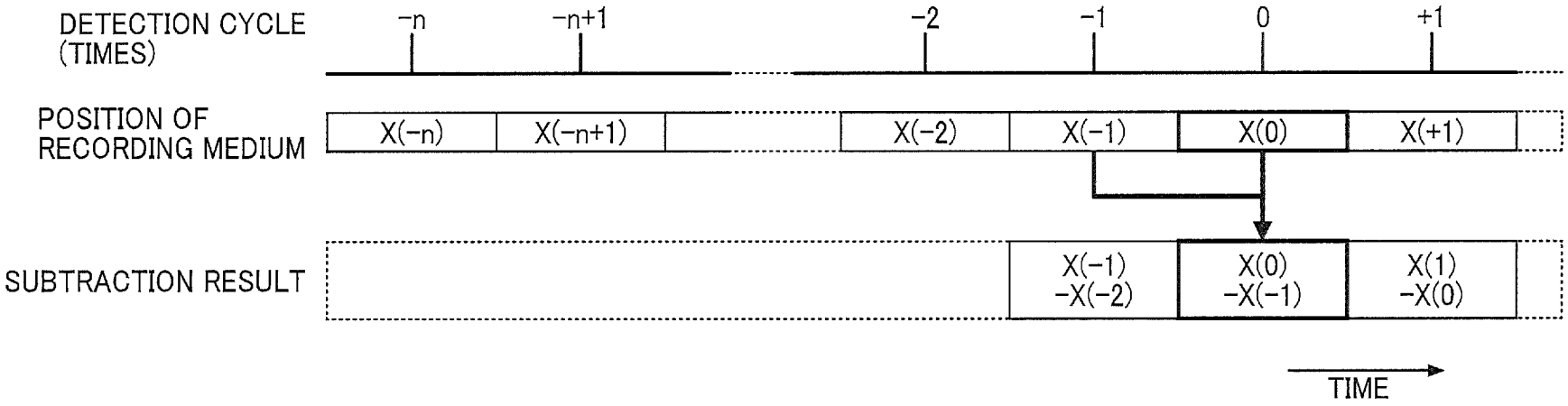
FIG. 12 is a diagram illustrating how the displacement of a recording medium or web is calculated, according to an embodiment of the present disclosure.

FIG. 12 is a diagram illustrating how the displacement of the web 120 is calculated, according to the present embodiment.

As illustrated in FIG. 12, the image forming apparatus 110 subtracts the current position of the recording medium from the position of the recording medium in one cycle before to calculate the displacement of the recording medium.

Hereinafter, cases in which the detection cycle is 0 times are described. In the present embodiment, as illustrated in FIG. 12, the image forming apparatus 110 subtracts X (0), which is a value indicating the current position of the recording medium, from X (−0), which is a value indicating the position of the recording medium in one cycle before as X (0)−X (−1), to calculate the displacement of the recording medium.

In the present embodiment, in the cycle before, the position of the recording medium is detected at a detection cycle of −1 times by the sensor, and the data is stored in the time shifting device 81. Next, the image forming apparatus 110 subtracts X (0) detected by the sensor from X (−1) indicated by the data stored in the time shifting device 81 to calculate the position of the recording medium.

In this manner, when the liquid discharge head unit 210 are moved and the liquid is discharged onto the web 120, for example, an image is formed on the recording medium.

Figure 13:
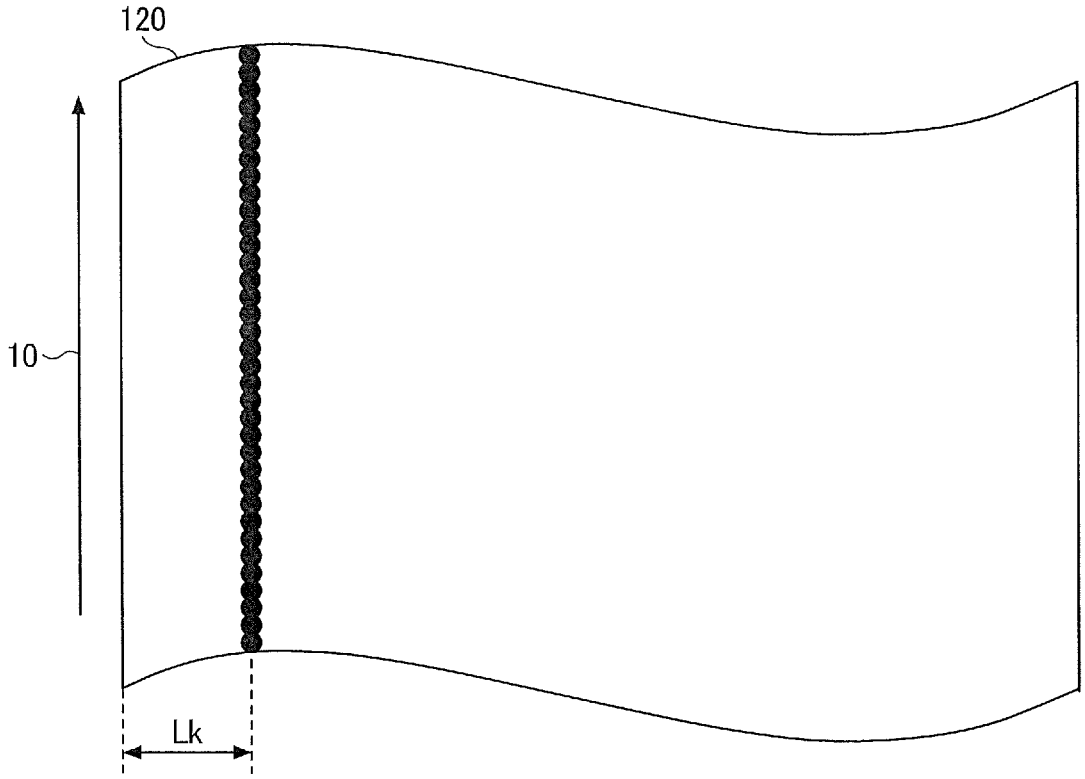
FIG. 13 is a diagram illustrating a test pattern on a web, according to an embodiment of the present disclosure.

FIG. 13 is a diagram illustrating a test pattern on the web 120 according to the present embodiment.

Firstly, as illustrated in FIG. 13, the image forming apparatus 110 forms a straight line in the conveyance direction 10 in black which is an example of the first color. In this manner, the image forming apparatus 110 performs test printing. A distance Lk from the edge of the web 120 is obtained from the result of the test printing. In this manner, when the distance Lk from the edge of the web 120 is adjusted manually or by the image forming apparatus 110 in the orthogonal direction 20, the position at which the ink of the first color as a reference, i.e., the black, is discharged, is determined. The method of determining the position at which the black ink is discharged is not limited to the above-described method.

Figure 14A:
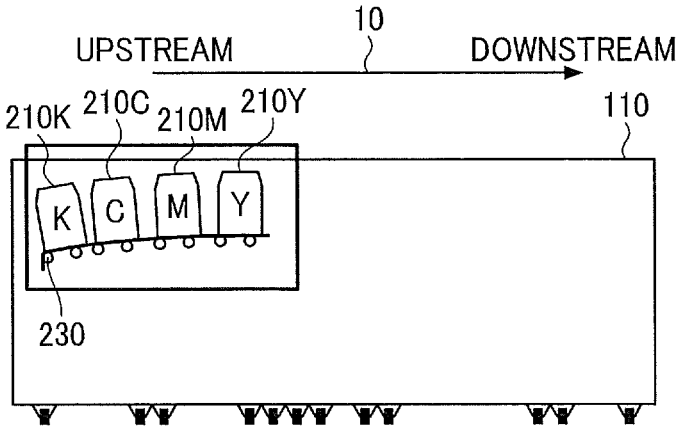
FIG. 14A is a side view of an image forming apparatus to illustrate the results of image formation processes, according to an embodiment of the present disclosure.
Figure 14B:
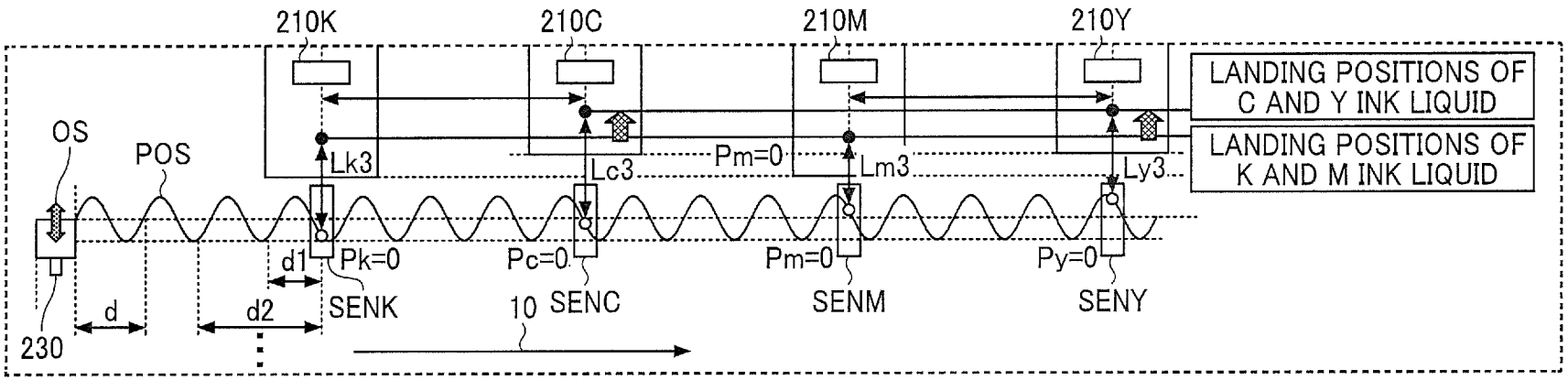
FIG. 14B is a plan view of the image forming apparatus of FIG. 14A to illustrate the results of image formation processes, according to an embodiment of the present disclosure.
Figure 14C:
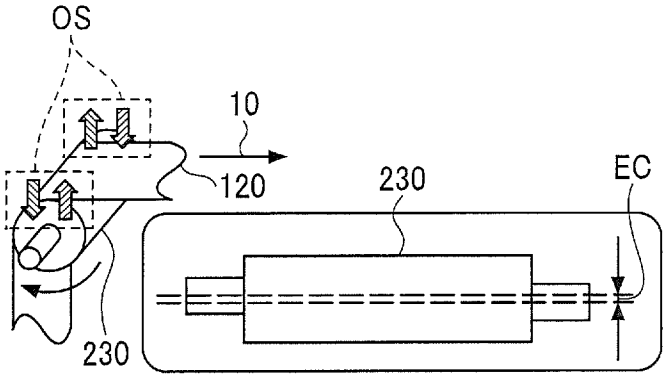
FIG. 14C is a perspective view of an eccentric roller according to an embodiment of the present disclosure.

FIG. 14A is a side view of the image forming apparatus 110 to illustrate the results of image formation processes, according to the present embodiment. FIG. 14B is a plan view of the image forming apparatus 110 of FIG. 14A to illustrate the results of image formation processes, according to the present embodiment. FIG. 14C is a perspective view of an eccentric roller 230 according to the present embodiment.

For example, as illustrated in FIG. 14A, image formation is performed in the order of black, cyan, magenta, and yellow. FIG. 14B is a top view of FIG. 14A, which is a so-called plan view.

Hereinafter, cases in which the roller 230 is eccentric are described. Specifically, as illustrated in FIG. 14C, there is eccentricity EC in the roller 230. As described above, when the eccentricity EC is present, swing OS occurs in the roller 230 when the roller 230 conveys the web 120. When the swing OS occurs, positions POS (see FIG. 14B) of the web 120 change. That is, for example, the meandering occurs due to the swing OS.

The image forming apparatus 110, for example, subtracts the current position of the recording medium detected by the sensors from the position of the recording medium in a cycle before to calculate a change in the position of the recording medium to reduce the color shift with respect to black.

Specifically, in the following description, first, the difference between the position of the web 120 detected by the sensor SENK for black and the position of the web 120 below the black liquid discharge head unit 210K is Pk.

The difference between a position of the web 120 detected by the sensor SENC for cyan and a position of the web 120 below the cyan liquid discharge head unit 210C is Pc in a similar manner. Further, the difference between a position of the web 120 detected by the sensor SENM for magenta and a position of the web 120 below the magenta liquid discharge head unit 210M is Pm. Furthermore, the difference between a position of the web 120 detected by the sensor SENY for yellow and a position of the web 120 below the yellow liquid discharge head unit 210Y is Py.

Subsequently, distances between each of the landing positions of black, cyan, magenta, and yellow ink and the edge of the web 120, i.e., the distances from the edge of the web 120 to the respective landing positions are defined as Lk3, Lc3, Lm3, and Ly3 for each color. In such a case, the position of the web 120 is detected by the sensors. Accordingly, Pk=0, Pc=0, Pm=0, and Py=0 are obtained. In view of such relation, first to third formula can be obtained as follows.

$$Lc3=Lk3-Pc=Lk3 \quad \text{First Formula}$$

$$Lm3=Lk3 \quad \text{Second Formula}$$

$$Ly3=Lk3-Py=Lk3 \quad \text{Third Formula}$$

In view of the first to third formula, a formula can be obtained as follows.

$$Lk3=Lm3=Lc3=Ly3$$

As described above, the image forming apparatus 110 moves the liquid discharge head unit 210 to reduce the displacement of the web 120. Thus, the image forming apparatus 110 can further enhance the accuracy of the landing positions in the orthogonal direction 20. In addition, when an image is formed, the liquid of each color is landed with high accuracy. Thus, the color shift can be reduced and the quality of the formed image can be enhanced.

Positions at which the sensors are installed, preferably, are located at positions at which a length of an outer peripheral d of the conveyance roller from the landing positions is multiplied.

By way of example, the position at which the sensor SENK for black is disposed is referred to in the following description. For example, if d is multiplied by 0 (d×0), the sensor SENK for black is disposed at a position close to the black ink landing position PK. Further, when d is multiplied by 1 (d×1), the sensor SENK for black is disposed at a position away from the black ink landing position PK by a distance equal to the circumference d of the conveyance roller multiplied by 1 (hereinafter referred to as first distance d1).

As illustrated in FIG. 14B, in the case in which d is multiplied by 1, (d×1), the sensor SENK for black is disposed at a position away from the black ink landing position PK by the first distance d1.

In a similar manner, when d is multiplied by 2 (d×2), the sensor SENK for black is disposed at a position that is twice the circumference d of the conveyance roller from the black ink landing position PK (hereinafter referred to as second distance d2). As illustrated in FIG. 14B, when d is multiplied by 2 (d×2), the sensor SENK for black is disposed at a position away from the black ink landing position PK by the second distance d2. The integral multiple may be three times or more.

An attachment error of the sensors, an error of the landing position, or, for example, both of these errors may be further added to the distances such as the first distance d1 and the second distance d2. The sensors may be provided for other colors in a similar manner.

Figure 15:
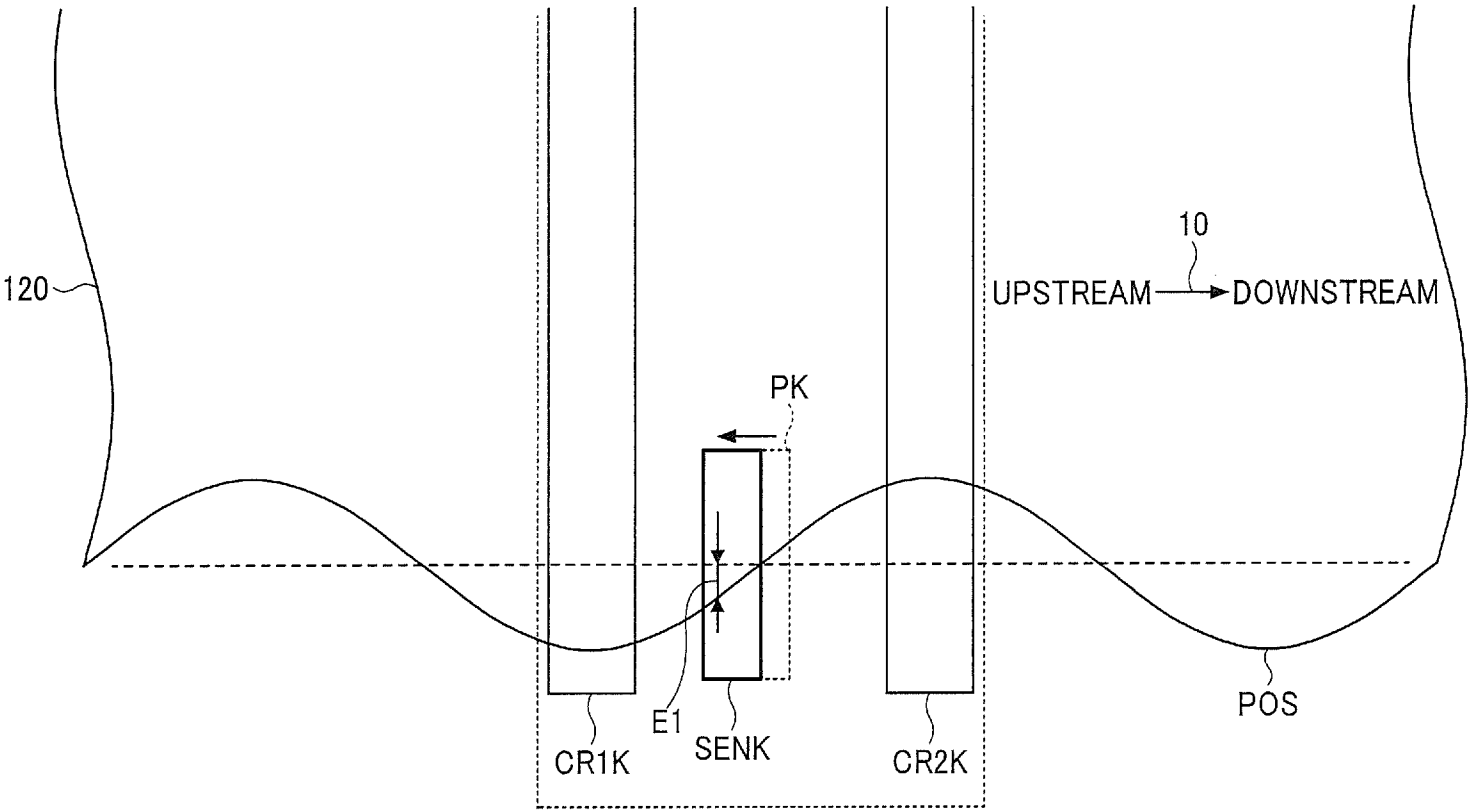
FIG. 15 is a diagram illustrating a position at which a sensor is disposed in a conveyance apparatus, according to an embodiment of the present disclosure.

FIG. 15 is a diagram illustrating a position at which the sensor SENK for black is disposed, according to the present embodiment.

Hereinafter, cases in which the color is black are described. In the present embodiment, desirably, the sensor SENK for black is disposed between the first roller CR1K for black and the second roller CR2K for black and at a position closer to the first roller CR1K for black than the black ink landing position PK.

A distance to which the sensor SENK for black can approach the first roller CR1K for black is determined based on the time necessary for the control operation. For example, the distance to which the sensor SENK for black can approach the first roller CR1K for black is set to 20 millimeters (mm). In this case, the position at which the sensor SENK for black is disposed is 20 mm upstream from the black ink landing position PK.

As described above, when the position at which the sensor SENK for black is installed is close to the black ink landing position PK, detection error E1 is small. Further, when the detection error E1 is small, the image forming apparatus 110 can accurately land the liquid of each color. Accordingly, when the image formation is performed, the liquid of each color is landed with high accuracy. Thus, the image forming apparatus 110 can reduce color shift and improve the image quality of an image to be formed.

In addition, such a configuration as described above allows to eliminate, for example, a restriction in which distances between each of the liquid discharge head units 210K, 210C, 210M, and 210Y need to be an integral multiple of the outer circumferential length d of the conveyance roller. Thus, the position at which each of the liquid discharge head units 210K, 210C, 210M, and 210Y is installed can be flexibly set. In other words, the image forming apparatus 110 can accurately land the liquid of each color even when the distances between adjacent ones of the liquid discharge head units 210K, 210C, 210M, and 210Y is a non-integral multiple of the outer circumferential length d of the conveyance roller.

Figure 16:
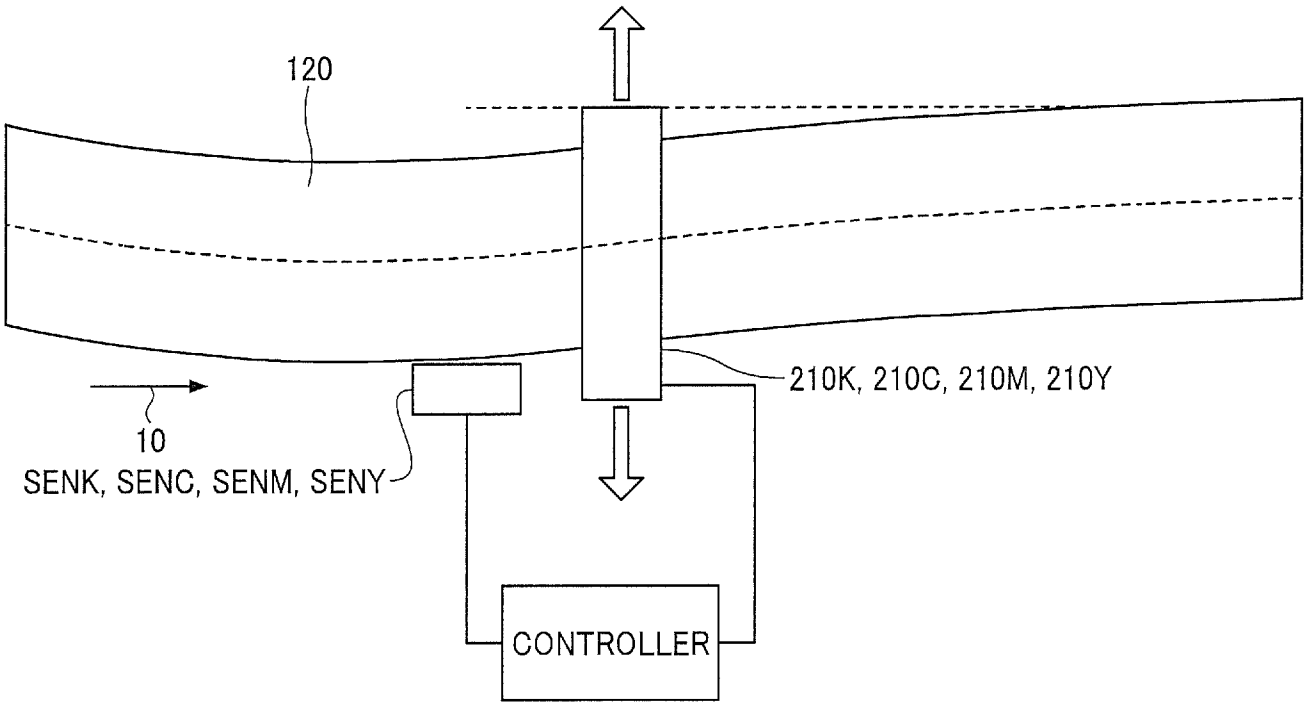
FIG. 16 is a diagram illustrating a web according to a first control sample of the above embodiments of the present disclosure.

FIG. 16 is a diagram illustrating the web 120 according to a first control sample of the above embodiments of the present disclosure.

In the first control sample, the position of the web 120 is detected before the liquid discharge head units 210K, 210C, 210M, and 210Y reaches the position at which the liquid is discharged. For example, in the first control sample, the position at which each of the sensors is installed is a position 200 mm upstream from immediately below the corresponding one of the liquid discharge head units 210K, 210C, 210M, and 210Y. Based on a detection result in the above-described case, in the first control sample, the image forming apparatus 110 moves the liquid discharge head units 210K, 210C, 210M, and 210Y to compensate for the displacement of the recording medium.

Figure 17:
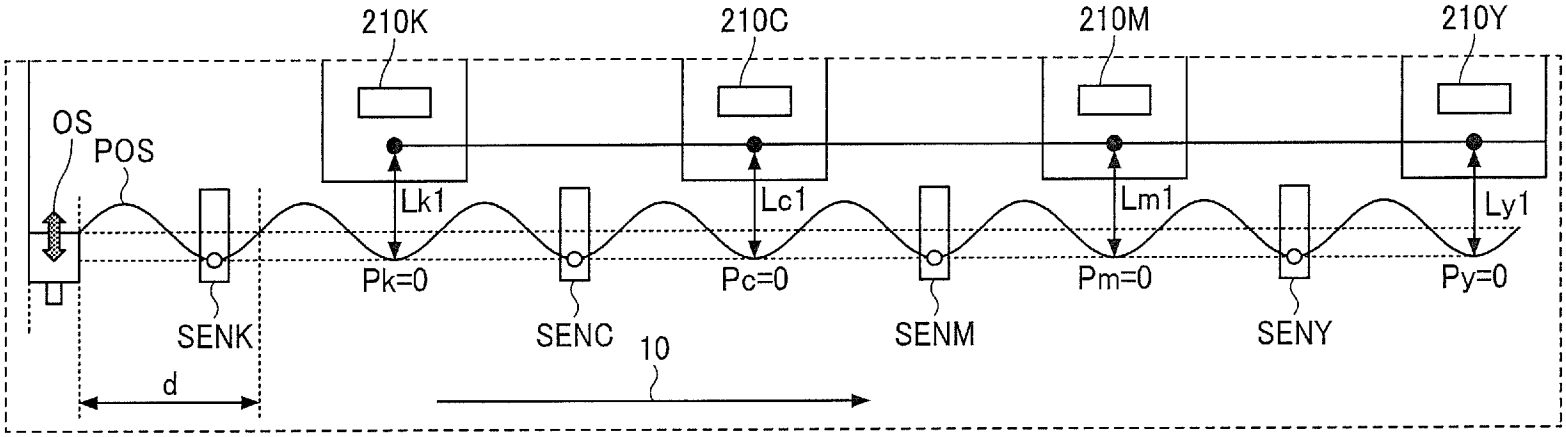
FIG. 17 is a diagram illustrating the results of image formation processes according to a first control sample of the above embodiments of the present disclosure.

FIG. 17 is a diagram illustrating results of image formation processes according to a first control sample of the above embodiments of the present disclosure.

In the first control sample, the liquid discharge head units 210K, 210C, 210M, and 210Y are disposed such that a distance between adjacent ones of the liquid discharge head units 210K, 210C, 210M, and 210Y is an integral multiple of the outer circumferential length d of the conveyance roller. In this case, the difference between the position of the web 120 detected by each of the sensors and the position of the web 120 immediately below the corresponding one of the liquid discharge head units 210K, 210C, 210M, and 210Y is 0. Accordingly, in the present control sample, when the landing positions of the liquid of black, cyan, magenta, and yellow with respect to the web 120 from the edge of the web 120 are distances, Lk1, Lc1, Lm1, and Ly1, respectively, the following formula is obtained.

$$Lk1=Lc1=Lm1=Ly1$$

As described above, the displacement of the web 120 is corrected.

Figure 18:
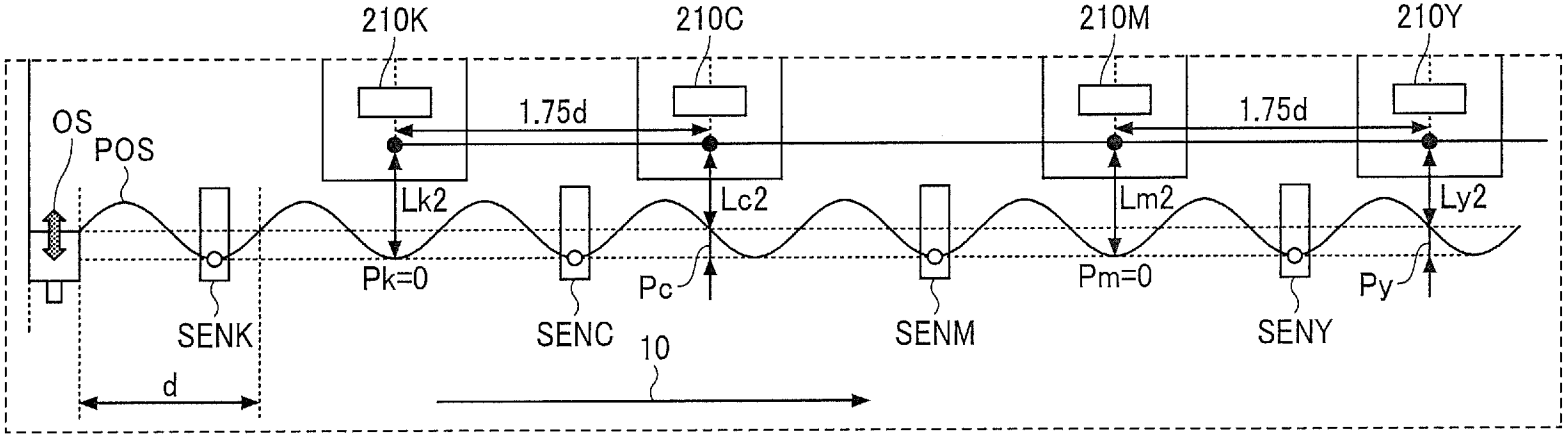
FIG. 18 is a diagram illustrating the results of image formation processes according to a second control sample of the above embodiments of the present disclosure.

FIG. 18 is a diagram illustrating the results of image formation processes according to a second control sample of the above embodiments of the present disclosure.

The hardware configuration in the second control sample is equivalent to the hardware configuration in the first control sample. The second control sample is different from the first control sample in that the distance between the black liquid discharge head unit 210K and the cyan liquid discharge head unit 210C and the distance between the magenta liquid discharge head unit 210M and the yellow liquid discharge head unit 210Y are 1.75d. In other words, in the second control sample, the distance between the black liquid discharge head unit 210K and the cyan liquid discharge head unit 210C and the distance between the magenta liquid discharge head unit 210M and the yellow liquid discharge head unit 210Y are each a non-integral multiple of the circumference d of the conveyance roller.

In the second control sample, similar to FIGS. 14A, 14B, and 14C, the difference between the position of the web 120 detected by the sensor SENK for black and the position of the web 120 below the black liquid discharge head unit 210K is Pk.

In a similar manner, the difference between the position of the web 120 detected by the sensor SENC for cyan and the position of the web 120 below the cyan liquid discharge head unit 210C is Pc. Further, the difference between the position of the web 120 detected by the sensor SENM for magenta and the position of the web 120 below the magenta liquid discharge head unit 210M is Pm. Furthermore, the difference between a position of the web 120 detected by the sensor SENY for yellow and a position of the web 120 below the yellow liquid discharge head unit 210Y is Py.

In addition, in the second control sample, when the landing positions of the ink of black, cyan, magenta, and yellow on the web 120 from the edge of the web 120 are distances, Lk2, Lc2, Lm2, and Ly2, respectively, a relationship such as fourth to sixth formula described below can be obtained.

$$Lc2=Lk2-Pc \quad \text{Fourth Formula}$$

$$Lm2=Lk2 \quad \text{Fifth Formula}$$

$$Ly2=Lk2-Py(2) \quad \text{Sixth Formula}$$

Accordingly, a following formula is obtained.

$$Lk2=Lm2\neq Lc2=Ly2.$$

As described above, the distance between the black liquid discharge head unit 210K and the cyan liquid discharge head unit 210C and the distance between the magenta liquid discharge head unit 210M and the yellow liquid discharge head unit 210Y are non-integral multiples of the circumference d of the conveyance roller. Accordingly, in the second control sample, the positions of the web 120 immediately below the cyan liquid discharge head unit 210C and the magenta liquid discharge head unit 210M are shifted by Pc and Py, respectively, and are different from positions detected by the sensor SENC for cyan and the sensor SENM for magenta, respectively. For this reason, the displacement of the web 120 is not compensated for. Thus, for example, undesired color shift is likely to occur.

Figure 19:
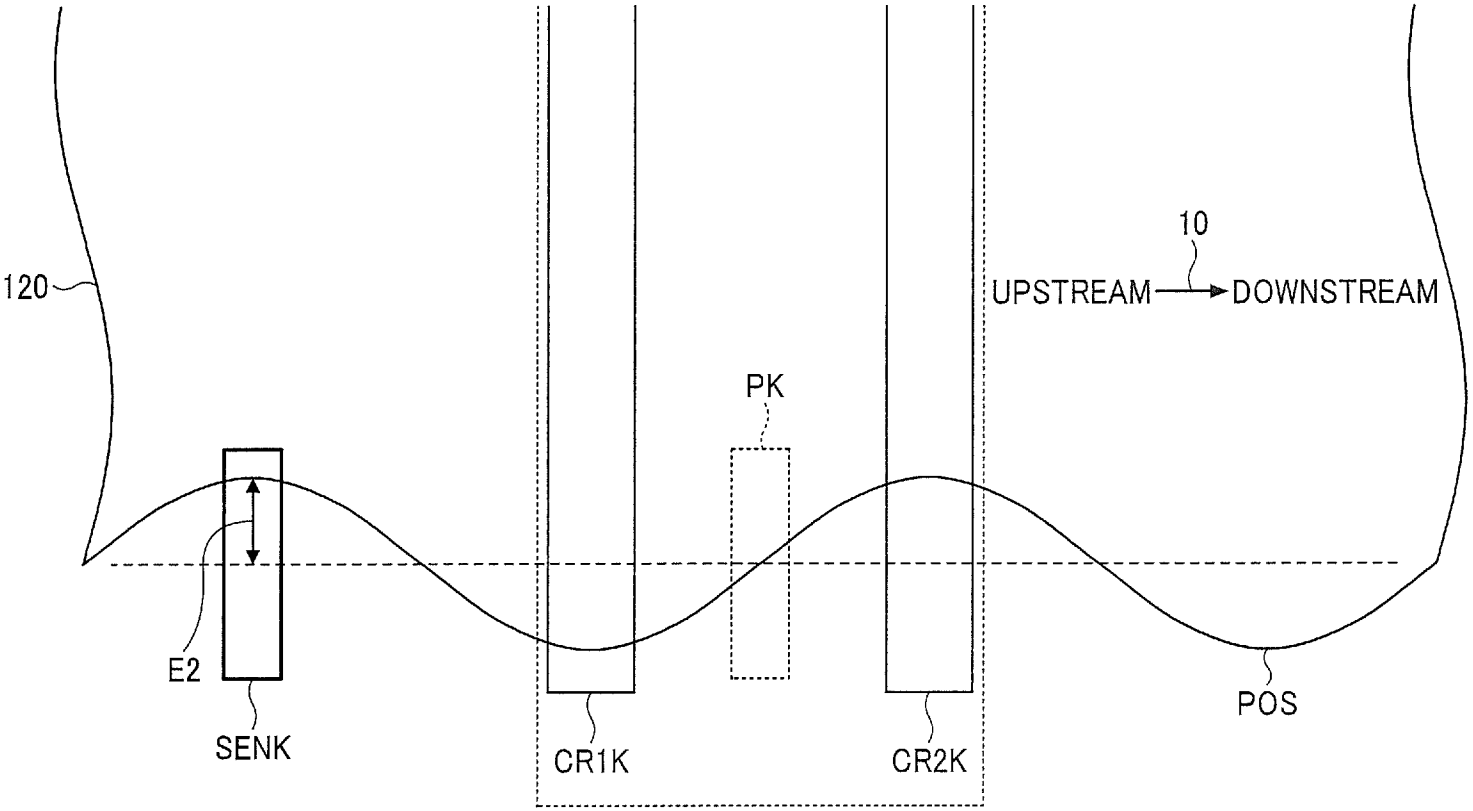
FIG. 19 is a diagram illustrating a position at which a sensor is disposed, according to another control sample of the above embodiments illustrated in FIG. 15 of the present disclosure.

FIG. 19 is a diagram illustrating a position at which the sensor SENK for black is disposed according to another control sample of the above embodiments of the present disclosure.

As illustrated in FIG. 19, in the present control sample, the sensor SENK for black is disposed at a position away from the black ink landing position PK. Accordingly, a detection error E2 in the control sample is likely to be large.

Figure 20:
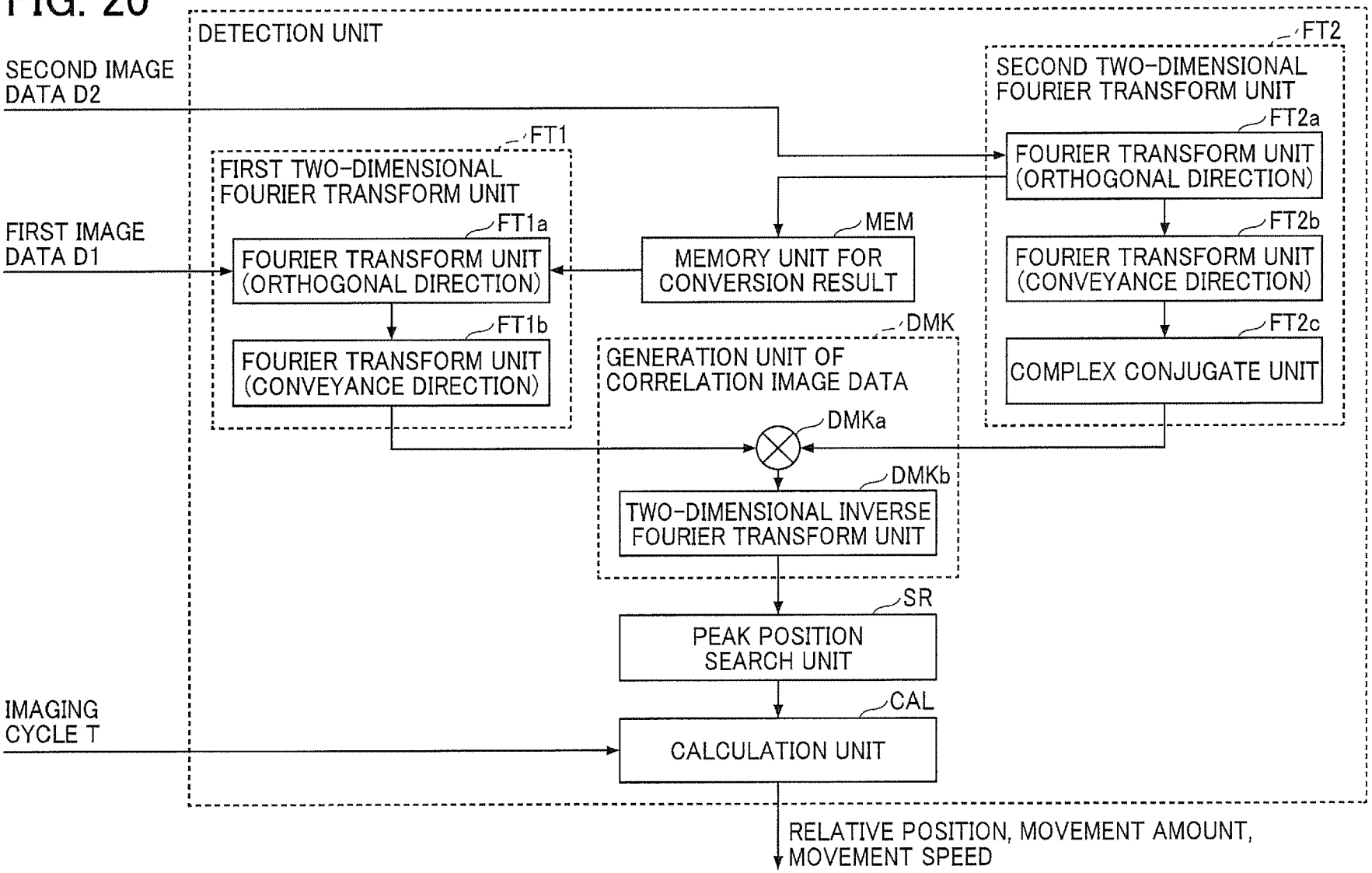
FIG. 20 is a diagram illustrating how a detection device provided for a conveyance apparatus examines a correlation, according to an embodiment of the present disclosure.

FIG. 20 is a diagram illustrating how a detection unit examines a correlation, according to the present embodiment.

For example, the detection unit performs correlation operation with a configuration as illustrated in FIG. 20 to calculate a relative position, a movement amount, a movement speed of the web 120, or a combination thereof at the position of each of the sensors.

More specifically, as illustrated in FIG. 20, the detection unit includes a first two-dimensional Fourier transform unit FT1, a second two-dimensional Fourier transform unit FT2, a correlation-image-data generation unit DMK, a peak-position search unit SR, a calculation unit CAL, and a conversion-result storage unit MEM.

The first two-dimensional Fourier transform unit FT1 transforms a first image data D1. Specifically, the first two-dimensional Fourier transform unit FT1 includes a Fourier transform unit FT1*a* for the orthogonal direction 20 and a Fourier transform unit FT1*b* for the conveyance direction 10.

The Fourier transform unit FT1*a* for the orthogonal direction 20 performs one-dimensional Fourier transformation of the first image data D1 in the orthogonal direction 20. Then, the Fourier transform unit FT1*b* for the conveyance direction 10 performs one-dimensional Fourier transformation of the first image data D1 in the conveyance direction 10 based on the result of transformation performed by the Fourier transform unit FT1*a* for the orthogonal direction 20. In this manner, the Fourier transform unit FT1*a* for the orthogonal direction 20 and the Fourier transform unit FT1*b* for the conveyance direction 10 perform one-dimensional Fourier transformation in the orthogonal direction 20 and the conveyance direction 10, respectively. The first two-dimensional Fourier transform unit FT1 outputs the above-described transformation result to the correlation image generation unit DMK.

In a similar manner, the second two-dimensional Fourier transform unit FT2 transforms a second image data D2. Specifically, the second two-dimensional Fourier transform unit FT2 includes a Fourier transform unit FT2*a* for the orthogonal direction 20, a Fourier transform unit FT2*b* for the conveyance direction 10, and a complex-conjugate unit FT2*c*.

The Fourier transform unit FT2*a* for the orthogonal direction 20 performs one-dimensional Fourier transformation of the second image data D2 in the orthogonal direction 20. Then, the Fourier transform unit FT2*b* for the conveyance direction 10 performs one-dimensional Fourier transformation of the second image data D2 in the conveyance direction 10 based on the result of transformation performed by the Fourier transform unit FT2*a* for the orthogonal direction 20. In this manner, the Fourier transform unit FT2*a* for the orthogonal direction 20 and the Fourier transform unit FT2*b* for the conveyance direction 10 perform one-dimensional Fourier transformation in the orthogonal direction 20 and the conveyance direction 10, respectively.

Next, the complex conjugation unit FT2*c* calculates the complex conjugate of the transformation result by the Fourier transform unit FT2*a* for the orthogonal direction 20 and the Fourier transform unit FT2*b* for the conveyance direction 10. The second two-dimensional Fourier transform unit FT2 outputs the complex conjugate calculated by the complex conjugate unit FT2*c* to the correlation-image data generation unit DMK.

Subsequently, the correlation-image data generating unit DMK generates a correlation image data based on the transformation result of the first image D1 output from the first two-dimensional Fourier transform unit FT1 and the result of transformation performed by the second image D2 output from the second two-dimensional Fourier transform unit FT2.

The correlation-image data generation unit DMK includes an integration unit DMKa and a two-dimensional inverse Fourier transform unit DMKb.

The integration unit DMKa integrates the transformation result of the first image data D1 and the transformation result of the second image data D2. Then, the integration unit DMKa outputs the integration result to the two-dimensional inverse Fourier transform unit DMKb.

The two-dimensional inverse Fourier transform unit DMKb performs two-dimensional inverse Fourier transform on the result of integration performed by the integration unit DMKa. When the two-dimensional inverse Fourier transform is performed as described above, correlation image data is generated. Then, the two-dimensional inverse Fourier transform unit DMKb outputs the correlation image data to the peak-position search unit SR.

The peak-position search unit SR searches the generated correlation image data for a peak position at which there is a peak luminance (peak value) that is the steepest (in other words, the luminance rises steeply). First, a value indicating the intensity of light, that is, the magnitude of luminance, is input to the correlation image data. Further, the luminance is input in a matrix.

In the correlation image data, values of the luminance are arranged at a pixel pitch interval of area sensors, that is, an interval of a pixel size. For this reason, desirably, the peak position is searched after so-called sub-pixel processing is performed. As described above, when the sub-pixel processing is performed, the peak position of the generated correlation image data can be searched with high accuracy. Accordingly, the detection device can accurately output, for example, the position, the movement amount, the movement speed of the web 120.

For example, the search by the peak-position search unit SR is performed as follows.

Figure 21:
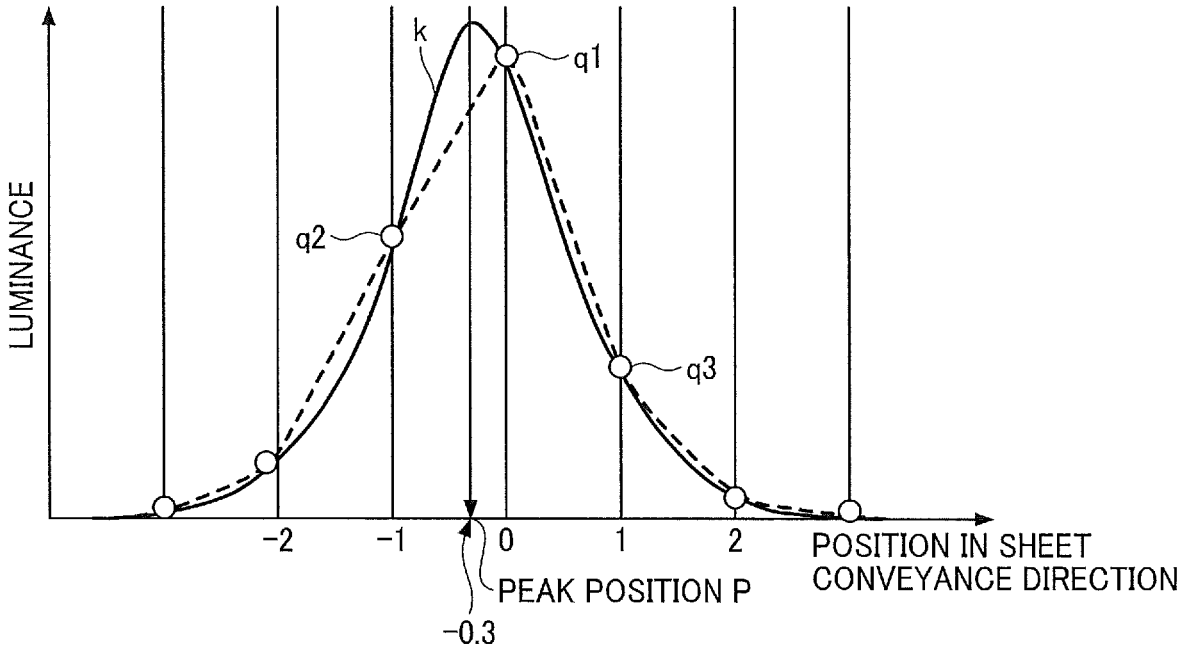
FIG. 21 is a graph illustrating how a peak of a curve that indicates the brightness in correlation image data is searched for, according to an embodiment of the present disclosure.

FIG. 21 is a graph illustrating how a peak of the curve that indicates the brightness in correlation image data is searched for, according to the present embodiment.

In FIG. 21, the horizontal axis indicates positions of the image indicated by the correlation image data in the conveyance direction 10. On the other hand, the vertical axis indicates the luminance of the image indicated by the correlation image data.

By way of example, in the present embodiment, among the values of the luminance indicated by the correlation image data, three data values including a first data value q1, a second data value q2, and a third data value q3 are referred to in the following description. In other words, in the present embodiment, the peak-position search unit SR searches for a peak position P in a curve k connecting the first data value q1, the second data value q2, and the third data value q3.

First, the peak-position search unit SR calculates a difference in data values of luminance between each of the images indicated by the correlation image data.

Then, the peak-position search unit SR extracts a combination of data values having a largest difference value among the calculated differences.

Next, the peak-position search unit SR extracts a combination of data values adjacent to the combination of data values having the largest difference value.

In this manner, the peak-position search unit SR can extract three data values such as the first data value q1, the second data value q2, and the third data value q3 illustrated in FIG. 21.

When the curve k is calculated by connecting the three extracted data values, the peak-position search unit SR can search for the peak position P.

In this way, the peak-position search unit SR can reduce the amount of calculation such as sub-pixel processing and search for the peak position P at higher speed.

The position of the combination of data values having the largest difference value is the steepest position. The sub-pixel processing may be processing other than the above-described processing.

As described above, when the peak-position search unit SR searches for the peak position, for example, the following calculation result is obtained.

Figure 22:
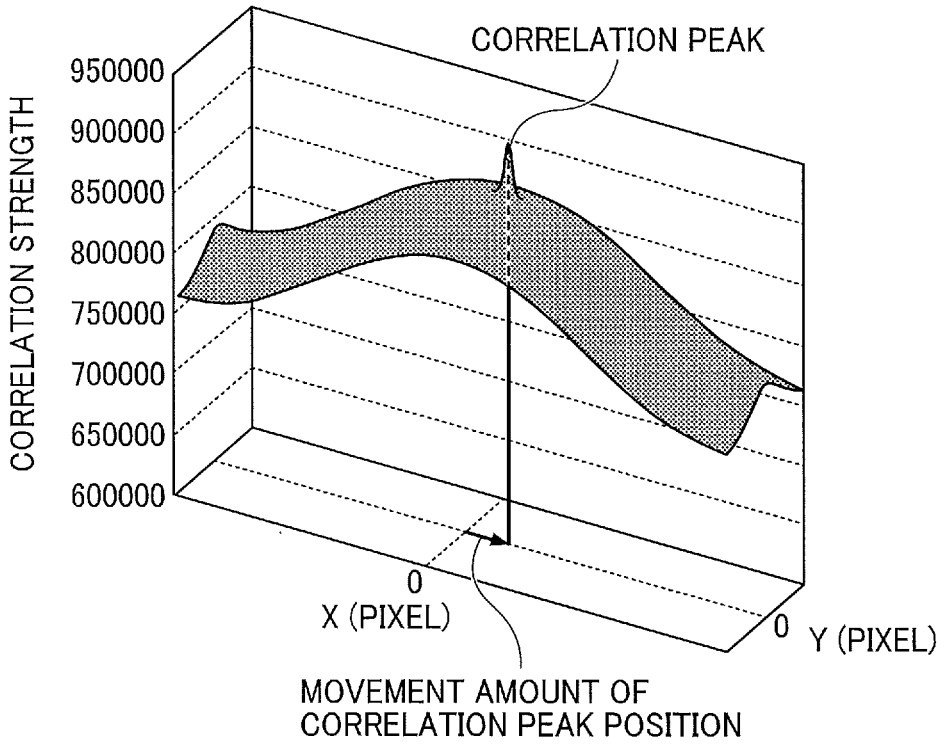
FIG. 22 is a graph illustrating a correlation intensity distribution of the cross-correlation function obtained as a result of the examination performed by a detection device, according to an embodiment of the present disclosure.

FIG. 22 is a graph illustrating a correlation intensity distribution of the cross-correlation function obtained as a result of the examination performed by a detection unit, according to the present embodiment.

In FIG. 22, X axe and Y axe indicate serial numbers of pixels. A peak position such as the correlation peak illustrated in FIG. 22 is searched for by the peak position unit SR.

The calculation unit CAL calculates, for example, a relative position, a movement amount, a movement speed of the web 120. For example, when the calculation unit CAL calculates the difference between the center position of a correlation image data and the peak position searched by the peak-position search unit SR, the calculation unit CAL can calculate the relative position and the movement amount of the web 120.

In addition, for example, the calculation unit CAL can divide the movement amount of the web 120 by time and calculate the conveyance speed of the web 120.

As described above, the detection unit can detect, for example, the relative position, the movement amount, the movement speed of the web 120 by the correlation calculation. A method of detecting, for example, the relative position, the movement amount, the movement speed of the web 120 is not limited to the above-described method. For example, the detection unit may detect, for example, the relative position, the movement amount, the movement speed of the web 120 as follows.

First, the detection unit binarizes the luminance of each of the first image data and the second image data. In other words, the detection unit sets 0 when the luminance is equal to or lower than a threshold set in advance, and sets 1 when the luminance is higher than the threshold. The detection unit may compare the first image data and the second image data that have been binarized as described above and detect the relative position of the first image data and the second image data.

In addition, the detection unit may detect, for example, the relative position, the movement amount, the movement speed of the web 120 by a detection method other than the above-described detection method. For example, the detection device may perform, for example, so-called pattern matching processing to detect the relative position of the web 120 from each pattern appearing in each image data.

Figure 23:
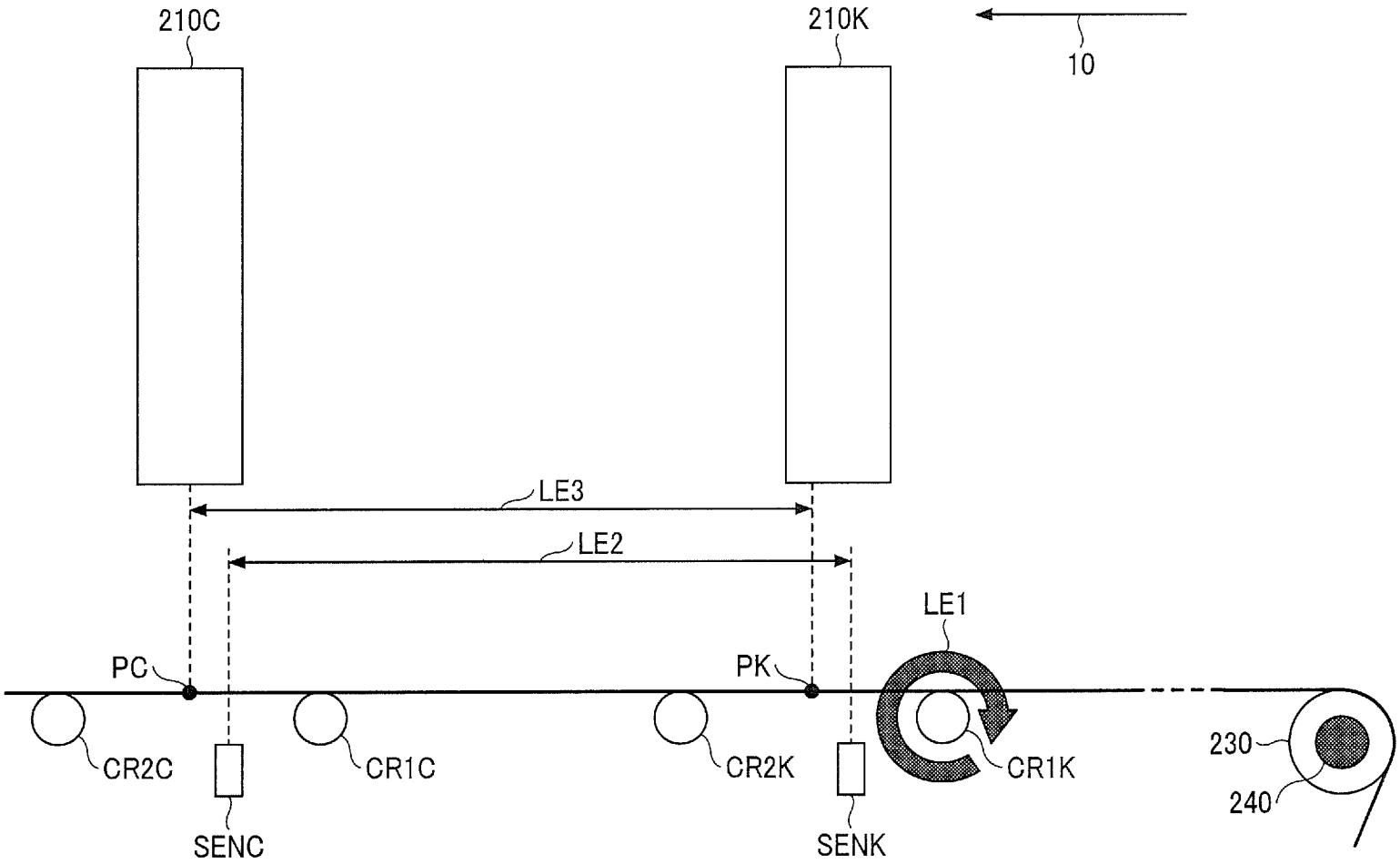
FIG. 23 is a diagram illustrating the distance between a pair of detection points and the distance between liquid discharge head units, according to an embodiment of the present disclosure.

FIG. 23 is a diagram illustrating the distance LE2 between a pair of detection points and the distance between the cyan liquid discharge head unit 210C and the black liquid discharge head unit 210K, according to the present embodiment.

By way of example, a combination of the black liquid discharge head unit 210K and the cyan liquid discharge head unit 210C is described below.

Hereinafter, the circumference of the first roller CR1K for black is referred to simply as a circumference LE1.

In the present embodiment described with reference to FIG. 23, the sensor SENK for black and the sensor SENC for cyan are disposed upstream from the black ink landing position PK and the cyan ink landing position PC, respectively. However, no limitation is indicated thereby, and the black ink landing position PK and the cyan ink landing position PC may match the sensor SENK for black and the sensor SENC for cyan, respectively.

Further, in the present embodiment described with reference to FIG. 23, the distance LE2 between a pair of detection points is equivalent to the distance between the sensor SENK for black and the sensor SENC for cyan. As described above, the distance LE2 between a pair of detection points indicates the distance between a position at which one of the above sensors performs detection and a position at which the other sensor performs detection.

The distance LE2 between a pair of detection points is an integral multiple of the circumference LE1. In view of such a relation between the LE2 and LE1, a seventh formula is obtained as follows.

$$LE2=LE1\times\alpha(\alpha=1,2,3.)$$

In the above formula, a denotes an integer by which the circumference LE1 is multiplied. The relation in the above seventh formula allows cancellation of displacements of the web 120 in high frequencies which is often caused by the conveyance rollers.

The speed at which the web 120 is conveyed is referred to as conveyance speed V120. A cycle in which the detection device performs detection is referred to as a sampling cycle TS. It is desired that the conveyance speed V120, the sampling cycle TS, and the circumference LE1 have a relation as in eighth formula given below.

$$V120\times TS<LE1\times\tfrac{1}{2}$$

The value obtained by multiplying the conveyance speed V120 by the sampling cycle TS, as in the left side of the eighth formula, indicates a sampling interval. Desirably, the sampling interval is longer than one half of the circumference LE1. Such a relation in the eighth formula allows the displacement of the web 120 to be detected by the sensors based on the sampling theorem.

Desirably, a value of the conveyance roller which has an influence on the displacement of the web 120 is adopted into the circumference LE1. In the present embodiment, the conveyance roller disposed on a nearest position upstream in the conveyance direction 10 affects the detection accuracy of the sensors.

More specifically, the detection by the sensor SENK for black is most affected by the displacement caused by the black roller CR1K for black. In the present embodiment, the first roller CR1K for black is positioned upstream from the sensor SENK for black in the conveyance direction and the web 120 that is conveyed via the first roller CR1K for black is an object to be detected by the sensor SENK for black. Thus, the influence of the black roller CR1K for black on the displacement of the web 120 is large. In addition, the first roller CR1K for black is a conveyance roller disposed at a position closest to the sensor SENK for black. Thus, detection by the sensor SENK for black is greatly affected.

The distance between a pair of liquid discharge head units (In FIG. 23, between the cyan liquid discharge head unit 210C and the black liquid discharge head unit 210C) is referred to as a distance LE3, and preferably, such a distance LE3 is also an integral multiple of the circumference LE1. For example, when the liquid discharge head units 210K, 210C, 210M, and 210Y and the respective sensors are disposed at the same position and disposed at the same intervals, the distance LE2 between a pair of detection points becomes equal to the distance LE3 between a pair of liquid discharge head units. Accordingly, based on the above seventh formula, the relation in the following formula is satisfied.

$$LE2=LE3=LE1\times\alpha$$

However, the distance LE2 between a pair of detection points and the distance LE3 between a pair of liquid discharge head units may not always be equal to each other. In other words, the distance LE2 between a pair of detection points and the distance LE3 between a pair of liquid discharge head units may be different from each other, and both the distance LE2 and the distance LE3 may be an integral multiple of the circumference LE1.

The combination of the sensors and the combination of the liquid discharge head units are not limited to the above-described combinations and may be other combinations.

The roller 230 is preferably provided with an encoder 240 as illustrated in FIG. 23. Hereinafter, a configuration using the encoder 240 is described. For example, when the distance LE2 is equal to the distance LE3 and the web 120 is conveyed by the distance LE2, the encoder 240 outputs N pulses. The N pulses are output at regular intervals.

Hereinafter, the displacement of the web 120 in the conveyance direction 10 detected between the two sensors based on the result of the detection of the web 120 by the sensor SENC for cyan at a time when the count of N is made after the detection by the sensor SENK for black, is set to ΔL. The above-described displacement ΔL is a detection result, and the displacement of the web 120 ΔL is detected in the sampling cycle TS.

The movement of the liquid discharge head unit 210, the control of the discharge by the liquid discharge head unit 210, or both are corrected to compensate for the displacement of the web 120 ΔL detected in this manner.

When the relation between the distance LE2 between a pair of detection points and the distance LE3 between a pair of liquid discharge head units is as in the seventh formula, the following detection results are obtained.

Hereinafter, a case in which the conveyance speed is 800 mm/sec is described as an example of low conveyance speed. On the other hand, a case in which the conveyance speed is 2000 mm/sec is described as an example of high conveyance speed. The case of the low conveyance speed and the case of the high conveyance speed are compared with each other in the following description. However, the conveyance speed, the distance LE2 between a pair of detection points, and the distance LE3 between a pair of liquid discharge head units are not limited to relations and values described below.

In the present embodiment described with reference to FIG. 24, LE3=LE2=LE1×α=200 mm.

Figure 24:
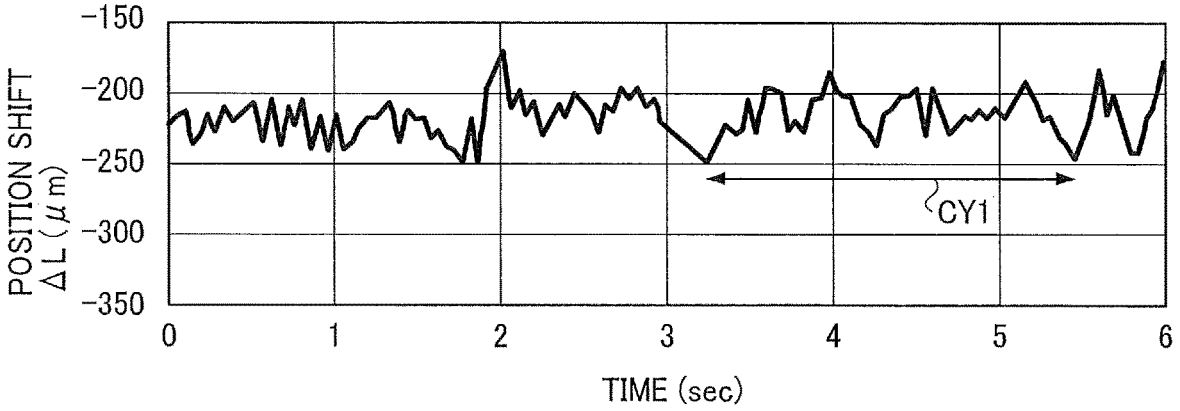
FIG. 24 is a graph illustrating a result of detection performed at low conveyance speed, according to an embodiment of the present disclosure.

FIG. 24 is a graph illustrating a result of detection performed at low conveyance speed, according to the present embodiment.

In the present embodiment described with reference to FIG. 24, it is assumed that the sampling cycle is 50 mm.

As illustrated in FIG. 24, a high-frequency component of the displacement of the web 120 ΔL caused by the conveyance rollers is canceled. On the other hand, as illustrated in FIG. 24, even if the displacement of the web 120 ΔL caused by the high-frequency component is cancelled, the displacement of the web 120 caused by a low-frequency component such as the first component CY1, which is lower in comparison with the high-frequency component by the conveyance rollers. When the number of samplings can be increased with respect to the first component CY1, the error between the actual displacement and the displacement detected between the sensors is reduced. Accordingly, the displacement of the recording medium, i.e., the web 120 can be detected with high accuracy.

Figure 25:
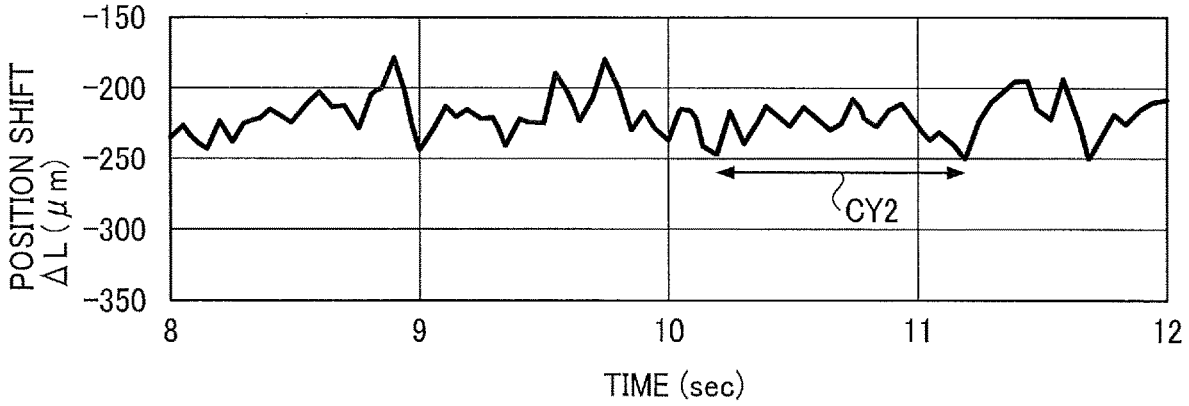
FIG. 25 is a graph illustrating a result of detection performed at high conveyance speed, according to an embodiment of the present disclosure.

FIG. 25 is a graph illustrating a result of detection performed at high conveyance speed, according to the present embodiment.

What are indicated by the vertical axis and the horizontal axis are the same as those of the vertical axis and the horizontal axis in FIG. 24. In other words, the conveyance speed in the detection result illustrated in FIG. 25 is higher than the conveyance speed illustrated in FIG. 24. For this reason, the displacement of the web 120 caused by the conveyance rollers is more likely to occur at a higher frequency than in the case illustrated in FIG. 24.

In the case illustrated in FIG. 25, the sampling cycle is 117 mm.

Even in such a case, when the distance LE3 between a pair of liquid discharge head units and the distance LE2 a pair of detection points are integral multiples of the circumference LE1, the displacement of the web 120 caused by the conveyance rollers is cancelled. The detection devices detect the displacement of the web 120 in a low frequency as in the second component CY2. Accordingly, even if the conveyance speed is high, the displacement of the web 120 caused by the conveyance rollers are cancelled. Thus, the displacement of the web 120 occurs in a low frequency, as in the second component CY2. For this reason, increasing the number of samplings allows to reduce the error between the actual displacement of the web 120 and the displacement of the web 120 detected between the sensors.

Using the detection result detected as described above allows the movement and correction of the liquid discharge head unit 210 to be accurately performed so as to handle the displacement of the web 120.

Control Samples

A control sample of the above embodiments of the present disclosure is described in which the distance LE3 between a pair of liquid discharge head units and the distance LE2 between a pair of detection points are not integral multiples of the circumference LE1 is described. In the present control sample, it is assumed that the following equation be satisfied.

$$LE3=LE2=352 \text{ mm } LE1\times\alpha=200 \text{ mm}$$

Accordingly, the present control sample is different from the experiment results described with reference to FIGS. 23, 24, and 25 in that the distance LE3 between a pair of liquid discharge units, the distance LE2 between a pair of detection points, and the circumference LE1 do not have the relation represented by the seventh formula.

Figure 26:
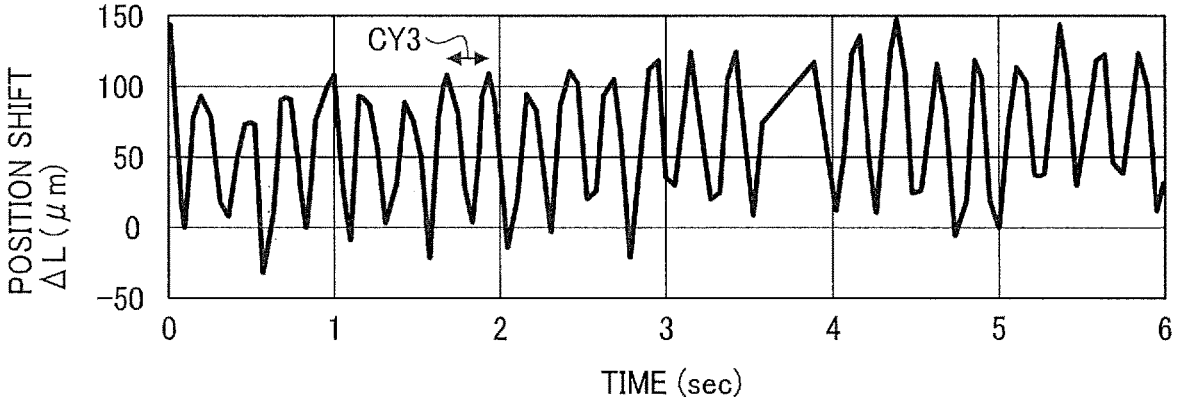
FIG. 26 is a graph illustrating a result of detection performed at low conveyance speed, according to a control sample of the above embodiments of the present disclosure.

FIG. 26 is a graph illustrating a result of detection performed at low conveyance speed, according to another control sample of the above embodiments of the present disclosure.

What are indicated by the vertical axis and the horizontal axis are the same as those of the vertical axis and the horizontal axis in FIG. 24. The conveyance speed in the present control sample is 800 mm/sec. In other words, in the present control sample, the conditions of the distance LE3 between a pair of liquid discharge head units and the distance LE2 a pair of detection points are the same as those in the detection performed at the low conveyance speed in the experiment described above with reference to FIG. 24.

In such a control sample of the above embodiments of the present disclosure, the displacement of the web 120 appears like a third component CY3. The cycle of the third component CY3 has a frequency of 4 Hz. Compared to, for example, the first component CY1, the third component CY3 has a shorter cycle, i.e., the displacement of the web 120 in a higher frequency.

Figure 27:
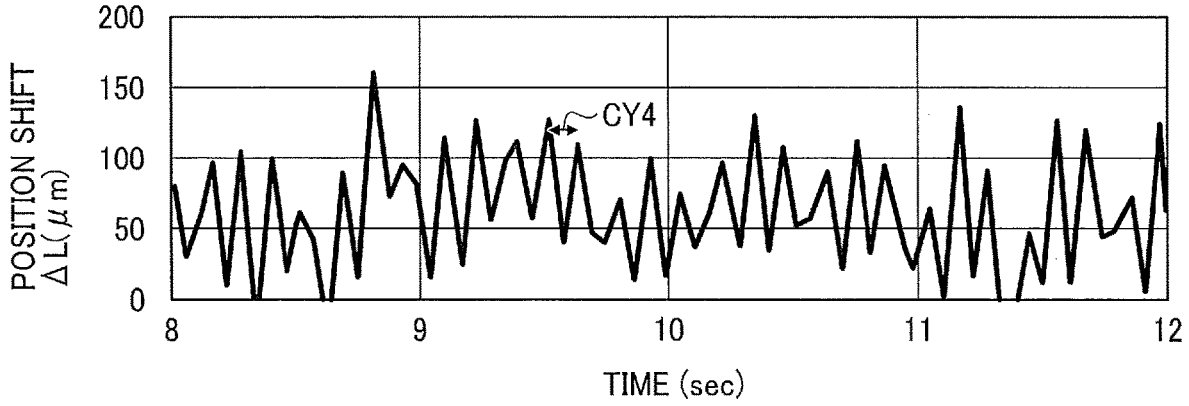
FIG. 27 is a graph illustrating a result of detection performed at high conveyance speed, according to a control sample of the above embodiments of the present disclosure.

FIG. 27 is a graph illustrating a result of detection at high conveyance speed, according to another control sample of the above embodiments of the present disclosure.

What are indicated by the vertical axis and the horizontal axis are the same as those of the vertical axis and the horizontal axis in FIG. 24. The present control sample is different from the control sample described above with reference to FIG. 26 in that the conveyance speed in FIG. 27 is higher than the conveyance speed in FIG. 26.

In such a control sample described with reference to FIG. 27, the displacement of the web 120 appears like a fourth component CY4. The cycle of the fourth component CY4 is a frequency of 7.3 Hz. Compared to, for example, the first component CY1, the fourth component CY4 has a shorter cycle. In other words, the displacement of the web 120 in a higher frequency appears in the fourth component CY4.

In the present control sample, the cycle of the conveyance roller is 10 Hz. On the other hand, the cycle of the fourth component CY4 is a frequency is 7.3 Hz. Thus, the cycle of the conveyance roller and the frequency of the fourth component CY4 do not match.

In many cases, the higher the conveyance speed, the shorter the cycle of the displacement of the web 120 caused by the conveyance rollers. In other words, as the conveyance speed increases, the frequency of the cycle of the displacement of the web 120 caused by the conveyance rollers increases in many cases.

As described above, it is difficult to detect the displacement of the web 120 unless the sampling cycle is shortened with respect to the cycle of the displacement of the web 120 caused by the conveyance rollers, which is shortened in accordance with the conveyance speed of the web 120. However, in many cases, the range in which the sampling cycle can be shortened is limited based on, for example, the specifications of the sensor.

When the sampling cycle is longer than one half of the circumference LE1, detecting the displacement of the web 120 based on the sampling cycle is difficult. In other words, even if the displacement of the web 120 that causes a deviation of the landing positions in the cycle of the conveyance rollers, occurs between the liquid discharge head units 210K, 210C, 210M, and 210Y, the cycle of the displacement of the web 120 detected by the sensors is different from 7.3 Hz. Thus, it is difficult to compensate for the displacement of the web 120 based on the displacement of the 10 Hz by moving and correcting the liquid discharge head unit 210.

Stretching of the web 120 may result in the displacement of the web 120 in a high-frequency. Even when the displacement of the web 120 in the high-frequency occur, arranging, for example, the distance LE2 between a pair of detection points as described above allows to cancel the displacement of the web 120 in the high-frequency. Further, setting a period in which the sensors perform detection, that is, a detection period allows the displacement of the web 120 having a frequency lower than the high frequency to be detected with high accuracy.

On the other hand, as illustrated by the experiment result in FIG. 25, when the distance LE2 between a pair of detection points is an integral multiple of the circumference LE1, the displacement of the web 120 caused by the conveyance rollers can be cancelled. The above-described cancellation of the displacement causes the displacement of the web 120 in a low-frequency. When the displacement of the web 120 is in a low-frequency, such a displacement can be detected by the sensors.

Modification

Figure 28:
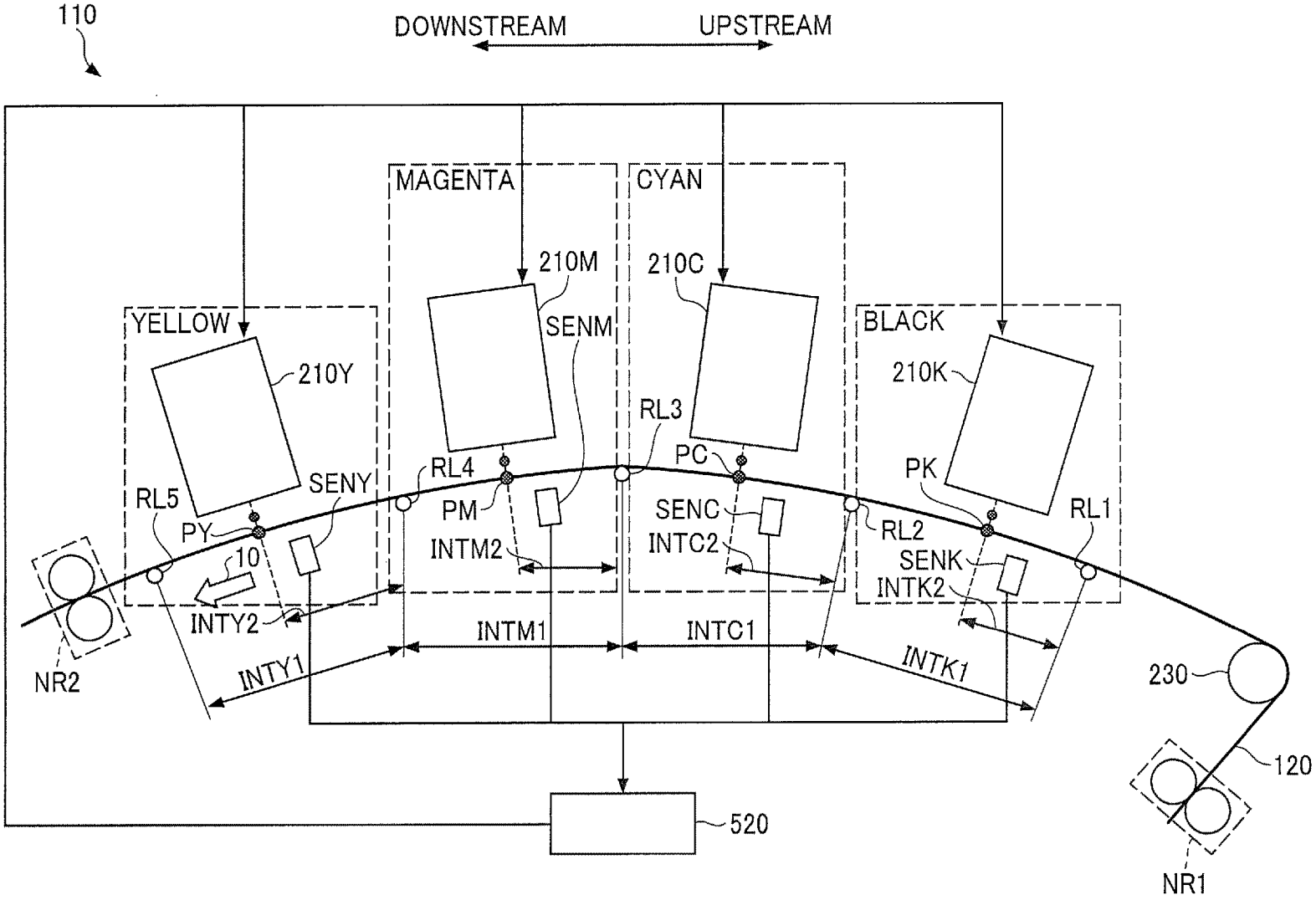
FIG. 28 is a diagram illustrating an overall configuration of a conveyance apparatus according to a modification of the embodiments of the present disclosure.

FIG. 28 is a diagram illustrating an overall configuration of the conveyance apparatus according to a modification of the embodiments of the present disclosure.

As compared with FIG. 2, the arrangement of the conveyance rollers in FIG. 28 is different. As illustrated in FIG. 28, the conveyance rollers may include, for example, a first conveyance roller RL1, a second conveyance roller RL2, a third conveyance roller RL3, a fourth conveyance roller RL4, and a fifth conveyance roller RLS. In other words, each of the conveyance rollers provided on a position upstream from the corresponding one of the liquid discharge head units 210K, 210C, 210M, and 210Y and each of the conveyance rollers disposed at a position downstream from the corresponding one of the liquid discharge head units 210K, 210C, 210M, and 210Y may be shared.

Figure 29:
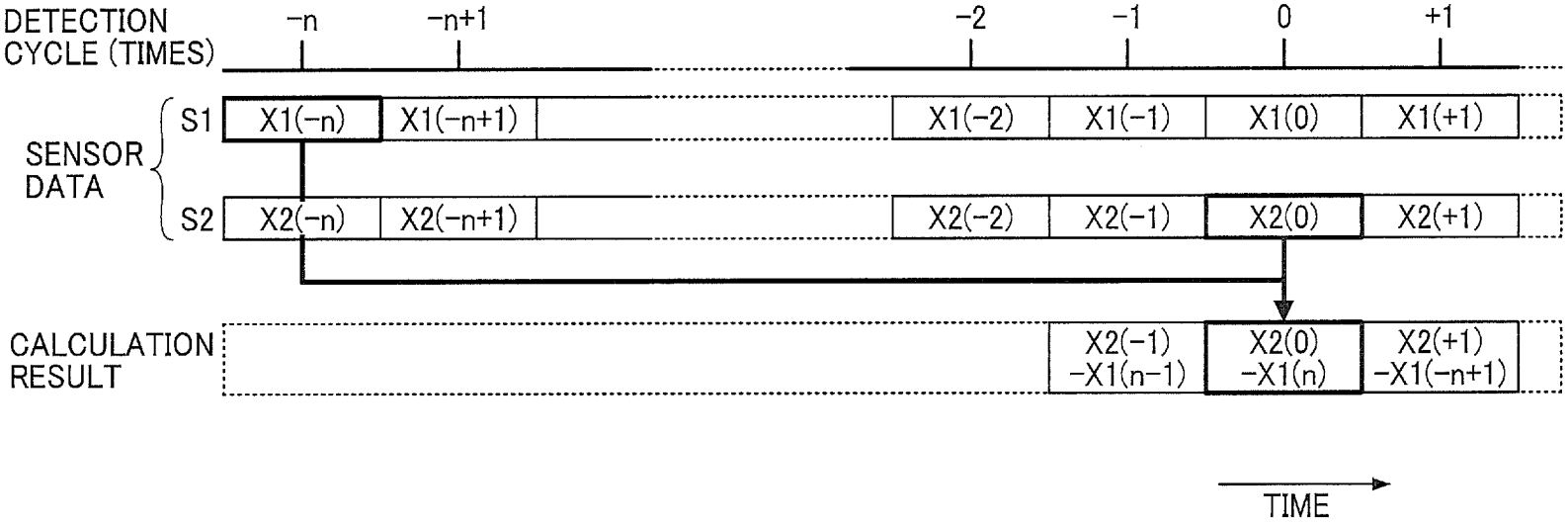
FIG. 29 is a diagram illustrating how the displacement of a recording medium or web is calculated, according to a modification of the embodiments of the present disclosure.

FIG. 29 is a diagram illustrating how the displacement of the web 120 is calculated, according to the present modification.

The displacement of the web 120 may be calculated in a manner as illustrated in FIG. 29. As illustrated in FIG. 29, the image forming apparatus 110 calculates the displacement of the web 120 based on a plurality of detection results. More specifically, a control unit CTRL outputs a calculation result indicating the displacement of the web 120 based on a first detection result S1 and a second detection result S2. First, the first detection result S1 and the second detection result S2 are detection results indicated by sensor data output from any two of the plurality of sensors.

In the present embodiment, the displacement of the web 120 is calculated for each of the liquid discharge head units 210K, 210C, 210M, and 210Y. In the present modification, the displacement of the web 120 is calculated based on, for example, a result of detection performed by the sensor SENC for cyan and a result of detection performed by the sensor SENK for black disposed at a position upstream from the sensor SENC for cyan adjacent to the sensor SENK for black.

In FIG. 29, the first detection result S1 is a result of detection performed by the sensor SENK for black. On the other hand, the second detection result S2 is a result of detection performed by the sensor SENC for cyan.

In the present modification, it is assumed that the distance between the sensor SENK for black and the sensor SENC for cyan, that is, the distance between the two sensors is L2. Further, it is assumed in the present modification that the moving speed of the web 120 detected by a speed detection circuit SCR is V. Further, it is assumed in the present modification that the time taken for an object, i.e., the web 120 to be conveyed from the position of the sensor SENK for black to the position of the sensor SENC for cyan is T2. In this case, the travel time is calculated as T2=L2/V.

Further, it is assumed in the present modification that the cycle in which the sensors perform sampling is set to A. Further, the number of times of sampling between the sensor SENK for black and the sensor SENC for cyan is n. In this case, the number of times sampling is performed is calculated by a formula given below.

$$T2=L2/V$$

Moreover, it is assumed in the present modification that the calculation result illustrated in FIG. 29, i.e., the displacement of the web 120 is ΔX. For example, as illustrated in FIG. 29, when the detection cycle is 0, the first detection result S1 before the movement time T2 is compared with the second detection result S2 of the detection cycle 0 to calculate the displacement of the web 120. More specifically, the displacement of the web 120 is calculated by a formula given below.

$$\Delta X=X2(0)-X1(n)$$

Then, when the position of each of the sensors is closer to the corresponding one of the first rollers than the corresponding one of the landing positions, the image forming apparatus 110 calculates a change of the position of the recording medium when the sheet of paper (web 120) moves to the position of the sensor, and drives the actuator based on the result of calculation.

Next, the image forming apparatus 110 controls the actuator to move the cyan liquid discharge head unit 210C in the orthogonal direction 20 so as to compensate for the displacement ΔX of the web 120. Such a configuration as described above allows the image forming apparatus 110 to form an image on the to-be-conveyed object with high accuracy even if the position of the object changes. Further, as illustrated in FIG. 29, when the displacement of the web 120 is calculated based on the two detection results, in other words, the detection results by the two sensors including the sensor SENK for black and the cyan sensor SENC, the displacement of the web 120 can be calculated without integrating the position information of each of the sensors. Accordingly, such a configuration as described above allows the accumulation of detection errors by the sensors to be reduced.

The calculation of the displacement of the web 120 may be performed for the other liquid discharge head units in a similar manner. For example, the displacement of the web 120 relative to the cyan liquid discharge head unit 210C is calculated with the first detection result S1 by the sensor SENK for black and the second detection result S2 by the cyan sensor SENC.

The displacement of the web 120 relative to the magenta liquid discharge head unit 210M is calculated with the first detection result S1 by the sensor SENC for cyan and the second detection result S2 by the sensor SENM for magenta in a similar manner.

Further, the displacement of the web 120 relative to the yellow liquid discharge head unit 210Y is calculated with the first detection result S1 by the sensor SENM for magenta and the second detection result S2 by the sensor SENY for yellow.

In addition, an additional sensor for black may be further provided, and the displacement of the web 120 relative to the black liquid discharge head unit 210K may be calculated with the second detection result S2 by the sensor SENK for black.

In addition, the detection result used for the first detection result S1 is not limited to the detection result detected by the sensor provided at a position upstream from the adjacent liquid discharge head unit to be moved. In other words, it is satisfactory as long as the first detection result S1 is a result of detection performed by a sensor disposed upstream from the liquid discharge head unit to be moved.

For example, the displacement of the web 120 relative to the yellow liquid discharge head unit 210Y may be calculated by using the detection result of any one of a second sensor SEN2, the sensor SENK for black, and the sensor SENC for cyan as the first detection result S1.

On the other hand, desirably the second detection result S2 is a result of detection performed by a sensor disposed at a position closest to the liquid discharge head unit to be moved.

Further, the displacement of the web 120 may be calculated based on three or more detection results.

As described above, when the liquid discharge head unit 210 are moved based on the displacement of the web 120 calculated from the plurality of detection results and the liquid is discharged onto the web 120, for example, an image is formed on the recording medium.

The liquid discharge apparatus according to the present disclosure may be included by a liquid discharge system including one or more apparatuses. For example, the black liquid discharge head unit 210K and the cyan liquid discharge head unit 210C may be devices in a same housing of an apparatus, the magenta liquid discharge head unit 210M and the yellow liquid discharge head unit 210Y may be devices in a same housing of another apparatus, and the liquid discharge system may include both of the two apparatuses.

In the liquid discharge apparatus and the liquid discharge system according to the present disclosure, the liquid is not limited to ink, and may be another type of recording liquid, such as fixing treatment liquid. In other words, the liquid discharge apparatus and the liquid discharge system according to the present disclosure may be applied to an apparatus that discharges a liquid of a type other than ink.

For this reason, the liquid discharge apparatus and the liquid discharge system according to the present disclosure are not limited to forming an image. For example, the object to be formed may be a three-dimensional object.

Further, the to-be-conveyed object is not limited to a recording medium such as a sheet of paper. The to-be-conveyed object may be made of a material onto which liquid can adhere. Examples of the material onto which liquid can adhere include any materials onto which liquid can adhere even temporarily such as paper, thread, fiber, fabric, leather, metal, plastic, glass, wood, and ceramic or combinations thereof.

Further, in the embodiments according to the present disclosure, among methods to discharge liquid, such as the image forming apparatus 110, the information processing apparatus, or a combination thereof, such as a computer, a program may execute a part or all of the method of discharging liquid.

Although the preferred embodiments of the present disclosure have been described in detail above, the present disclosure is not limited to the specific embodiments, and various modifications or changes can be made within the scope of the gist of the present disclosure described in the claims.

In the above descriptions, the term "printing" in the present disclosure may be used synonymously with, e.g. the terms of "image formation", "recording", "printing", and "image printing".

The suffixes Y, M, C, and K attached to each reference numeral indicate only that components indicated thereby are used for forming yellow, magenta, cyan, and black images, respectively, and hereinafter may be omitted when color discrimination is not necessary.

What is claimed is:

1. A conveyance apparatus comprising:

a liquid discharge head unit configured to discharge liquid to an object conveyed in a conveyance direction;

a conveyance rotator configured to convey the object; and a plurality of detection devices configured to output a detection result indicating a position of the object, wherein adjacent two of the plurality of detection devices are spaced at a prescribed distance and wherein the prescribed distance is an integral multiple of a circumference of the conveyance rotator.

2. The conveyance apparatus according to claim 1, wherein a value obtained by multiplying a conveyance speed at which the object is conveyed and a sampling cycle performed by the plurality of detection devices is smaller than one half of the circumference of the conveyance rotator.

3. The conveyance apparatus according to claim 1, wherein the plurality of detection devices include optical sensors.

4. The conveyance apparatus according to claim 1, wherein the plurality of detection devices are configured to detect a pattern on the object to output the detection result.

5. The conveyance apparatus according to claim 4, wherein the pattern is generated by light projected on unevenness of a surface of the object, and wherein the plurality of detection devices are configured to capture an image of the pattern on the object to output the detection result based on the image.

6. The conveyance apparatus according to claim 1, wherein the object is a continuous sheet long in the conveyance direction.

7. The conveyance apparatus according to claim 1, further comprising a plurality of liquid discharge head units including the liquid discharge head unit, wherein a distance between adjacent two of the plurality of liquid discharge head units is an integral multiple of the circumference or is equal to the prescribed distance.

8. The conveyance apparatus according to claim 1, further comprising a controller configured to correct control of discharge by the liquid discharge head unit or move the liquid discharge head unit, based on the detection result.

9. The conveyance apparatus according to claim 1, wherein the plurality of detection devices are configured to output the detection result for an orthogonal direction to the conveyance direction or for both the conveyance direction and the orthogonal direction.

10. An image forming apparatus comprising the conveyance apparatus according to claim 1.

* * * * *